US009102342B2

(12) United States Patent
Graber

(10) Patent No.: US 9,102,342 B2
(45) Date of Patent: Aug. 11, 2015

(54) LOCOMOTIVE ACOUSTIC WARNING SYSTEM

(71) Applicant: Curtis E. Graber, Woodburn, IN (US)

(72) Inventor: Curtis E. Graber, Woodburn, IN (US)

( * ) Notice: Subject to any disclaimer, the term of this patent is extended or adjusted under 35 U.S.C. 154(b) by 125 days.

(21) Appl. No.: 13/742,707

(22) Filed: Jan. 16, 2013

(65) Prior Publication Data

US 2013/0214097 A1 Aug. 22, 2013

Related U.S. Application Data

(60) Provisional application No. 61/600,027, filed on Feb. 17, 2012.

(51) Int. Cl.

| | |
|---|---|
| ***B61L 23/00*** | (2006.01) |
| ***B61L 29/24*** | (2006.01) |
| *B61L 25/02* | (2006.01) |

(52) U.S. Cl.

CPC ..... *B61L 29/246* (2013.01); *B61L 23/00* (2013.01); *B61L 25/025* (2013.01); *B61L 2205/04* (2013.01)

(58) Field of Classification Search

CPC ..... B61L 1/00; B61L 3/02; B61L 7/00; B61L 13/00; B61L 13/007; B61L 23/00; H04R 1/00

USPC ..... 246/111–114 R, 122 R–124, 473 R, 246/473.1; 381/86, 97

See application file for complete search history.

(56) References Cited

U.S. PATENT DOCUMENTS

| | | | | |
|---|---|---|---|---|
| 6,416,021 | B2 | 7/2002 | Greene, Jr. | |
| 7,075,427 | B1 | 7/2006 | Pace et al. | |
| 7,106,180 | B1 | 9/2006 | Pompei | |
| 7,395,140 | B2 * | 7/2008 | Christie et al. | 701/19 |
| 7,400,972 | B2 | 7/2008 | Kozak | |
| 7,508,320 | B2 | 3/2009 | Taylor | |
| 7,832,691 | B2 | 11/2010 | Reibeling et al. | |
| 8,600,071 | B2 * | 12/2013 | Nakayama et al. | 381/86 |
| 2007/0102591 | A1 | 5/2007 | Toth | |
| 2007/0262881 | A1 | 11/2007 | Taylor | |
| 2008/0212805 | A1 | 9/2008 | Fincham | |
| 2011/0026729 | A1 * | 2/2011 | Nakayama et al. | 381/86 |
| 2012/0318932 | A1 | 12/2012 | Parida et al. | |

* cited by examiner

*Primary Examiner* — R. J. McCarry, Jr.
(74) *Attorney, Agent, or Firm* — Taylor IP, P.C.

(57) ABSTRACT

A sound system for a locomotive mounts a loudspeaker line array for broadside firing forward from the vehicle. Additional loudspeakers are installed on the locomotive for projecting sound to the sides. A control system applies drive signals to the loudspeakers of the line array with the control system providing phase adjustment of drive signals applied to each loudspeaker of the line array to control side to side directional steering of a projected sound beam. The control system includes an automated, location dependent sub-system for selecting beam width and directional steering of a projected sound beam.

14 Claims, 32 Drawing Sheets

82
83
84
85
86
87
88
89
90
91
92
93
94
95
96
97
98
99
100
101
102
103
104
105
106
107
108
109
110
111
112
113
114
115
116
117
118
119
120
121
122 steered + -6 -3 shading steered + -9 -6 shading

LOCOMOTIVE ACOUSTIC WARNING SYSTEM

REFERENCE TO RELATED APPLICATION AND PRIORITY CLAIM

This application claims the benefit of U.S. Provisional Patent Application Ser. No. 61/600,027 filed 17 Feb. 2012.

BACKGROUND

1. Technical Field

The field relates to warning systems and more particularly to a locomotive mounted, directional, acoustic warning system.

2. Description of the Problem

Train horns can either supplement or provide the only acoustic alarm at railway/road crossings. In the United States train horn use is regulated by the Federal Railroad Administration (FRA). Since 2005 regulations have provided that for trains moving slower than 45 mph the locomotive horn be sounded at least 15, but not more than 20, seconds before a locomotive enters a crossing. For trains moving faster than 45 mph the horn is to be sounded at designated locations. The train horn is to be sounded using is two long tones, a short tone and one additional long tone. This pattern is repeated until the lead locomotive has entered the crossing.

Despite the effectiveness of horns in giving warning to motorists and others, the use of horns in some areas is unpopular. The State of Florida attempted to ban the sounding of locomotive horns, but such a blanket prohibition ran afoul of federal preemption issues. Provisions have been made to allow local authorities an option of establishing quiet zones provided effective alternative safety measures are in place.

SUMMARY

A sound system for a ground vehicle comprises a line array of loudspeakers installed across the front of the ground vehicle. The line array is operated in a broadside firing mode to project a sound beam generally forward from the vehicle while allowing steering of the sound beam from side to side off center line. First and second loudspeakers are installed on the ground vehicle for projecting sound to the sides of the ground vehicle. A control system applies drive signals to the loudspeakers of the line array and to the first and second side loudspeakers. The control system provides phase adjustment of drive signals applied to each loudspeaker of the line array to control beam width and side to side directional steering of the sound beam relative to the direction of travel of the ground vehicle. The control system includes an automated, geographical location sensitive sub-system for selecting beam width and directional steering of a projected sound beam to be generated by the line array.

BRIEF DESCRIPTION OF THE DRAWINGS

Understanding of the following description may be enhanced by reference to the accompanying drawings, wherein.

DETAILED DESCRIPTION

Figure 1:
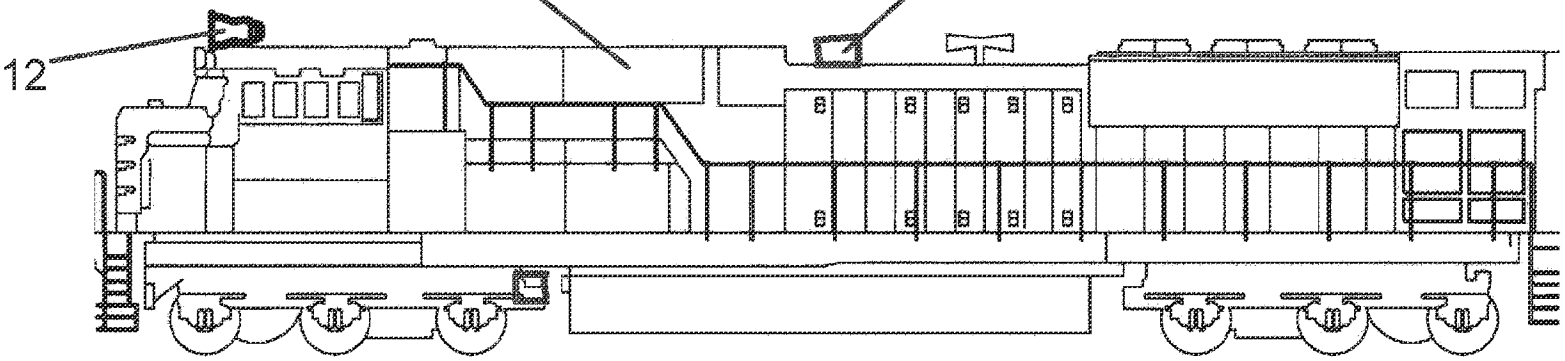
FIG. 1 is a side elevation of a locomotive on which a loudspeaker system has been installed as a substitute or supplement for an air horn system.
Figure 2:
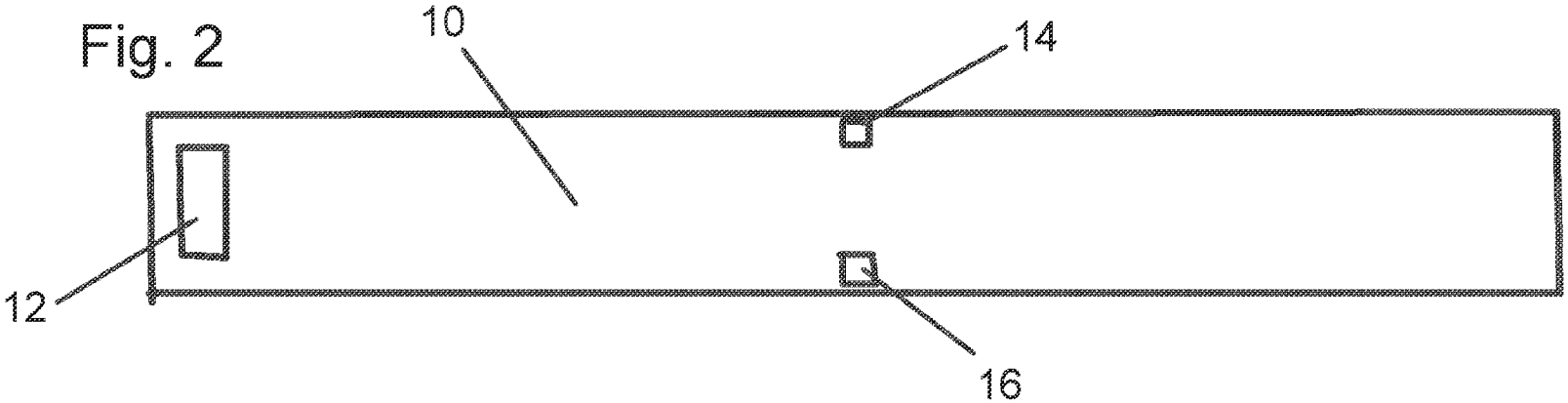
FIG. 2 is a top plan view of the locomotive of FIG. 1 illustrating the location of a front directed loudspeaker array and two side directed loudspeakers.

Referring to the figures, and particularly to FIGS. 1 and 2, a ground vehicle such as a locomotive 10 is illustrated on which a loudspeaker system has been installed for the purpose of emitting acoustic warning of approach of the ground vehicle to a location, particularly locations adjacent a level grade road crossing with railroad tracks. The loudspeaker system comprises a forward directed loudspeaker line array 12 and first and second side directed loudspeakers 14 and 16. The line array 12 is positioned horizontally with respect to the tracks supporting the locomotive and has a primary or neutral sound projection axis aligned on the longitudinal axis of the locomotive 10. The first and second side directed loudspeakers 14 and 16 oriented to project sound away from the right and left sides of locomotive 10. The front directed loudspeaker line array 12 and the side directed loudspeakers 14, 16 are mounted on top of the locomotive 10 to provide unobstructed projection of sound.

Figure 4:
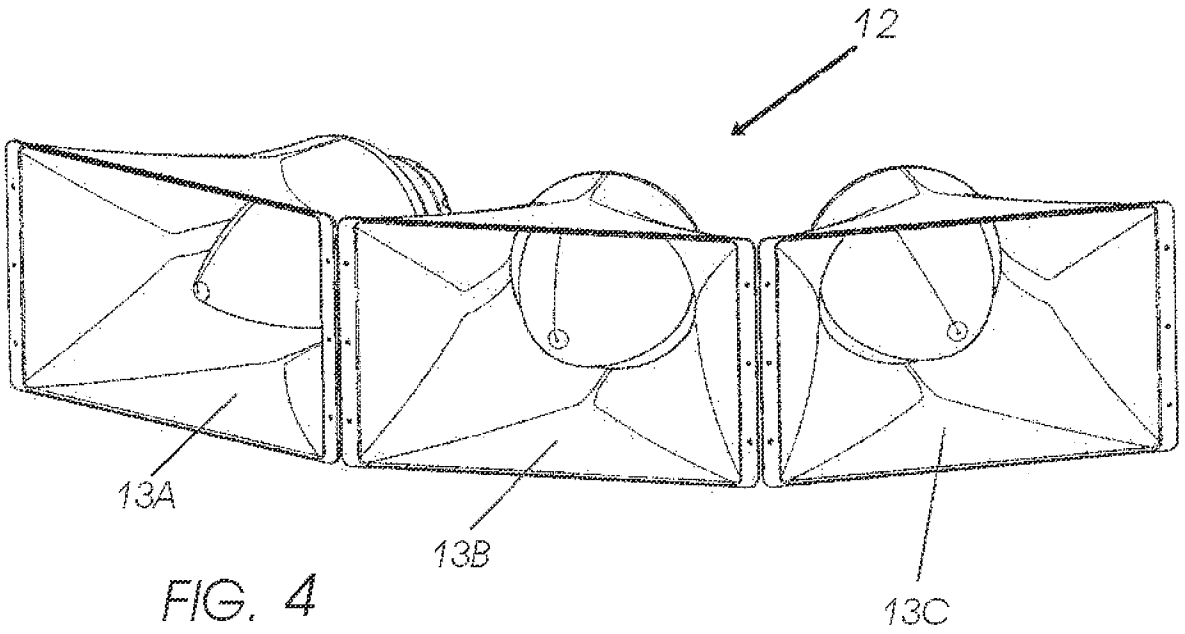
FIG. 4 is a perspective view of the loudspeaker line array.
Figure 5:
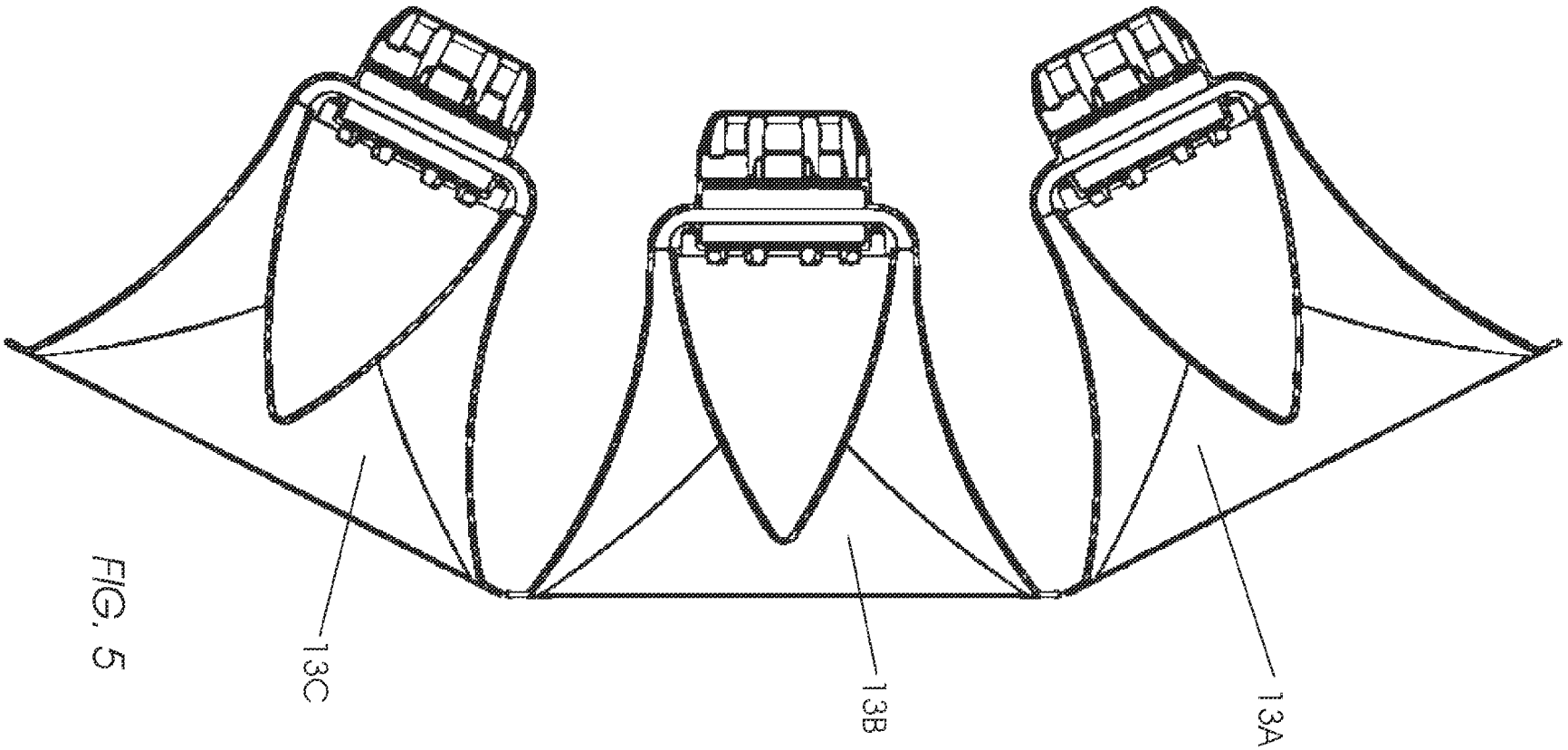
FIG. 5 is a cross sectional view of the loudspeaker line array.

A loudspeaker line array 12 is illustrated in FIGS. 4 and 5. Loudspeaker line array 12 comprises at least three loudspeakers 13A, 13B and 13C. Traditionally air horns have been used on locomotives in order to obtain the desired sound level output. The present applicant has submitted an application for an electro/acoustical transducer system utilizing opposed transducers directed into a waveguide assembly entitled RADIAL WAVEGUIDE FOR DOUBLE CONE TRANSDUCER, U.S. patent application Ser. No. 13/346,077 filed 9 Jan. 2012, which is incorporated herein by reference. Transducer and waveguide assemblies such as disclosed in the incorporated application may be utilized for the loudspeakers 13A-C of line array 12 and for side directed loudspeakers 14 and 16. This device is sometimes referred to herein as a "Tandem Horn."

Loudspeaker line array 12 is constructed with its center loudspeaker 13B which, when mounted on a locomotive 10, is intended to be directed straight ahead aligned on the longitudinal axis of the locomotive 10. Outboard loudspeakers 13A, 13C are canted outwardly away from the longitudinal axis of the locomotive 10 and located slightly behind the center loudspeaker 13B making the line array a gently curved or staggered line array. Gently curved line arrays are known from several sources including U.S. Patent Application Publication No. 2008/0212805 (a symmetric system) and U.S. Pat. No. 6,870,942 (a non-symmetric system). Line array 12 is disposed on the locomotive 10 with its axis of elongation generally parallel to the ground, or more precisely, generally parallel to the local plane of the tracks that the locomotive 10 rides on. The acoustic centers of adjacent loudspeakers are spaced from one another by about 18 inches.

Figure 3:
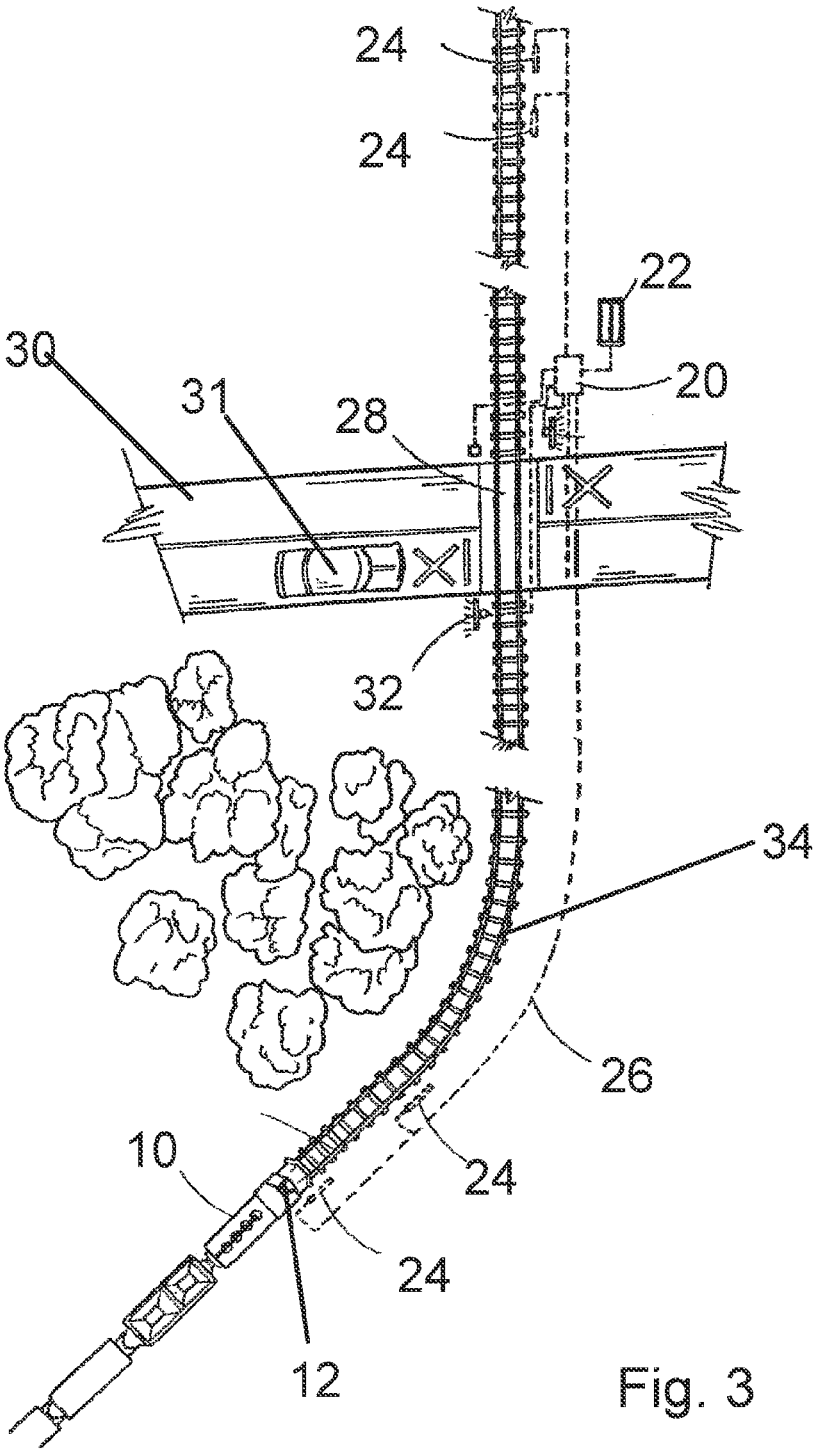
FIG. 3 depicts an operating scenario for the system.

Referring to FIG. 3 a locomotive 10 located on a railroad track 18 is equipped with a forward directed loudspeaker array 12. Locomotive 10 is shown in a position along an approach to a level grade crossing 28 of a road 30 with track 18. The approach path of the locomotive 10 to the level grade crossing 28 is not along a straight line as a bend 34 in the tracks 18 occurs between the location of the crossing guard triggers 24 and the level grade crossing 28. The locations of vehicles and pedestrians along their respective lines of approach to the level grade crossing 28, that is on or along road 30, may vary from straight ahead of the locomotive 10 to locations well of the longitudinal axis of the locomotive. Approach of a locomotive 10 to the region into which a warning is to be broadcast by the locomotive horn system may not be straight for reasons other than bends in the tracks 18. For example, the road or path crossing the tracks 18 may incorporate turns and/or cross the tracks at other than a perpendicular angle and the angle may change either away from or closer to the center line of the locomotive 10 as it approaches. In addition, the speed at which the locomotive 10 is traveling affects the timing of sounding of an alert from the locomotive. A car 31 is located on the road 30 approaching level grade crossing 28 short of a flasher/bell warning system 32 to illustrate a possible location where sound energy is to be directed.

Under normal circumstances, upon locomotive 10 passing crossing guard triggers 24, signals are sent along a crossing guard trigger cable 26 to an automatic crossing guard controller 20 which controls activation of the flasher/bell warning system 32. This system can be used to trigger operation of a crossing guard transponder 22 which can transmit data to or be interrogated by a control system on locomotive 10 for reports on operating condition of the flasher/bell warning system 32. Crossing guard transponder 22 may be equipped to provide local weather conditions, particularly wind direction and speed at the level grade crossing 28. Crossing guard transponder 22 may be locally programmed to provide special instructions or a beam profile to an approaching locomotive 10 as described below.

Forward directed loudspeaker line array 12 can serve to supplement the flasher/bell warning system 32 by emulating a train horn targeting the approaches to level grade crossing 28. Line arrays compress sound emitted from the array into a primary/major and secondary lobes extending radially from the line array 12 in a plane parallel to the ground and aligned on the locomotive, assuming no beam steering. The horizontally disposed array allows the primary/major lobe or beam of sound from the array to be steered in the horizontal plane parallel to the ground using techniques of phase adjustment, amplitude shading and frequency shading among the loudspeakers 13A-C of the line array 12. Confining most sound energy to lobes, and controlling the direction and width of the lobes can be used to reduce sound spill over into areas away from the approaches to the level grade crossing 28, compensating for bends 34 in the track 18, or non-perpendicular approaches of roads 30 ton the tracks.

Figure 6:
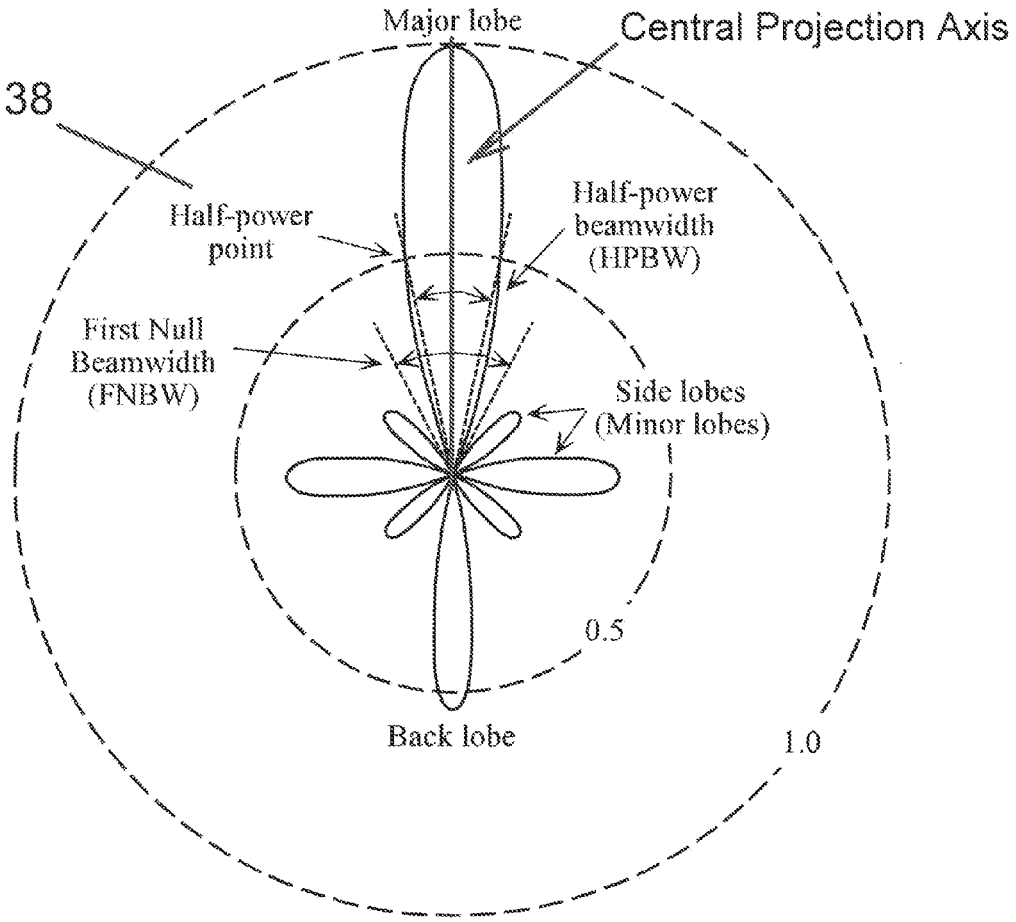
FIG. 6 is a simple, theoretical polar plot for a directivity pattern for the front directed loudspeaker line array.

FIG. 6 illustrates a simple directivity pattern 38 at a particular frequency for forward directed loud speaker line array 12. The line array 12 is set for broadside firing with a minimum of phase adjustment and frequency and amplitude shading. Directivity pattern 38 is in a plane to the ground with the central projection axis/major lobe and back lobe usually aligned on the longitudinal axis of locomotive 10. The major lobe can be displaced in either direction outwardly (but parallel to the ground) from the locomotive's longitudinal axis by beam steering. The spread of the major lobe to −10 dB may be varied by adjusting phase differences between the loudspeakers of the line array 12.

While the primary beam lobe is normally set for a narrow beam of 42-45 degrees (about 22 and ½ degrees each side of center) at the primary frequency, for an emergency condition such as a vehicle on the track the beam could be actively focused the a minimum beam waist and steered directly at the target to create the maximum available acoustic power to the target. Video or radar could be used to determine precise location bearing to the target and processing applied to deliver maximum energy density to the selected target(s)

The primary beam lobe emulates the sound pressure of a standard pneumatic train horn, however the substantial decrease in acoustic sound power at all angles of the system other than the primary beam lobe decrease the noise pollution to surrounding areas. Additional settings (enhancements) of the signal processing allow the array system to have additional decreased output to the null areas where sound energy is to be minimized due to the proximity of houses and businesses. In testing average side attenuation of −18 to −24 db from the primary beam lobe was achieved, however alternative DSP settings produced attenuation levels as great as −42 db from the primary beam lobe in portions of the acoustic spectrum.

The ability to program waveforms allows for high contrast ratio lower duty-cycle alert tones could be mixed with the train 5 tone sounds to create a louder and higher percentage attention getting signal for use in conditions where the standard train horn sounds are ineffective. In addition, selectable "engineered per species" sound tracks could be chosen to directly deter wildlife from the front of the trains path in the case of obstruction of the tracks. A secondary passive noise absorption housing can be applied to the system to lower the side/rear emission levels even beyond the adaptive null created with the array. The system can be operated via remote location via live data links and or operated in an autonomous response mode eliminating the requirements of a live systems operator on-board.

Focusing sound energy from the front directed loudspeaker line array 12 into lobes avoids spillover into areas adjacent the tracks where the sound is not needed and beam steering allows sound energy to be directed to compensate for level grade crossings which are non-standard. The provision of side directed loudspeakers 14, 15, which are not installed in arrays and are less directional than the array allows sound to be directed more to the sides of the locomotive 12. Active steering (left-center-right-center-left etc.) of the main primary acoustic lobe would allow the system to produce a sound in motion effect that would increase the attention getting capability of the system for emergency operations. Increasing the number of loudspeakers in array 12 provided greater control over beam steering and lobe spreading.

In a test arrangement an array 12 was built with a mechanical splay angle was set at 35 degrees so center horn was at 0 degrees with the left side horn set at 35 degrees to center and the right side at 35 degrees to center. A 42 degree beam was formed when the center horn was phase delayed 0.318 ms from the outside horns. A 60 degree beam was formed when the center horn was phase delayed 0.120 ms from the outside horns. A 85 degree beam was formed when the center horn was phase delayed 0.060 ms from the outside horns. A 120 degree beam was formed when the outside horns were phase delayed 0.298 ms from the center horn. A 198 degree beam was formed when the outside horns were phase delayed 0.918 ms from the center horn. A right steered beam of 20 degrees was formed with a left phase delay 0.00 ms, center 0.121 ms, right 0.815 ms setting.

Figure 7:
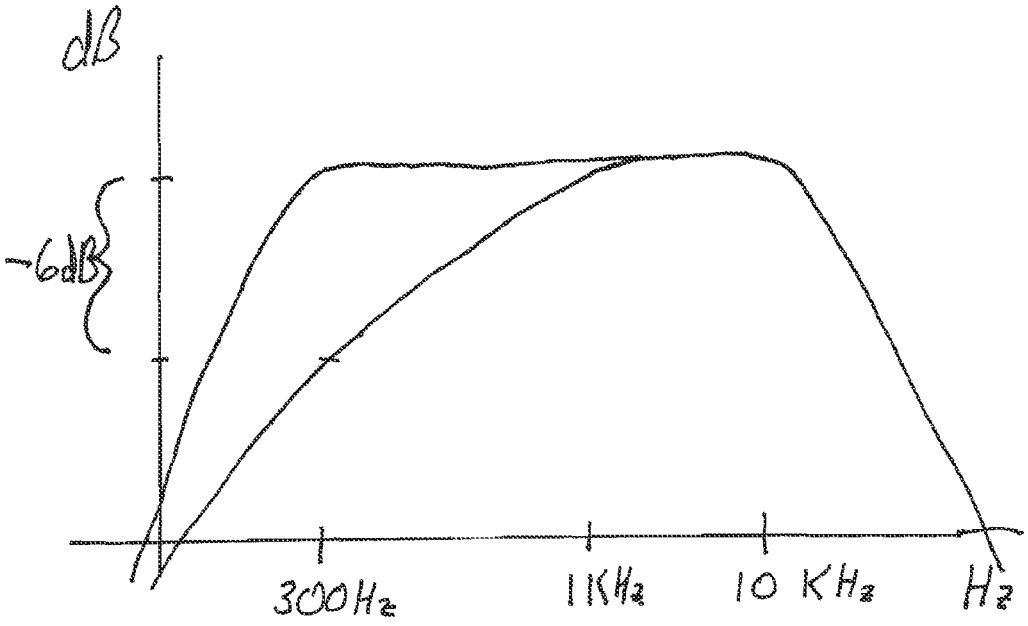
FIG. 7 is a graph illustrating frequency shading using a two speaker example.

FIG. 7 illustrates frequency shading for a pair of loudspeaker with the output amplitude for one speaker ramped up to a plateau between 300 Hz and 10 KHz and another loudspeaker having a more gradual ramp up to the plateau from below 1 KHz.

Figure 8:
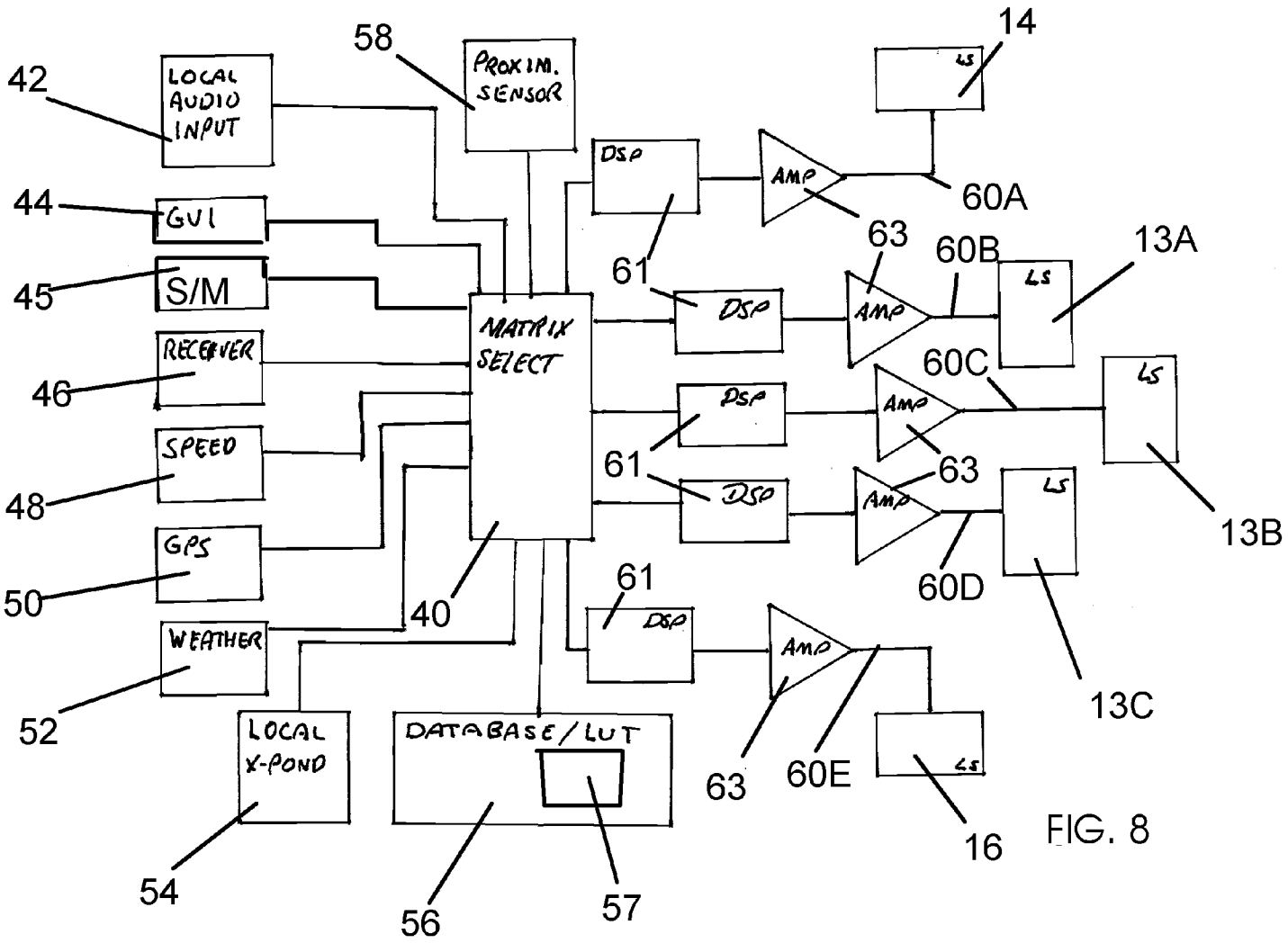
FIG. 8 is a block diagram of a control arrangement for the loudspeaker system.

FIG. 8 is a block diagram for a control system for side directed loudspeakers 14, 16 and front directed loudspeaker line array 12. An on board computer or matrix select controller 40 generates/supplies selected audio input signals to each loudspeaker channels 60A-E. The audio input signal may be virtually any signal including frequencies in the human range of hearing, but usually includes a frequency mix which emulates a train horn or captures a voice input. Each of channels 60A-E is physically substantially identical, however, channels 60A-C, which drive loudspeakers 13A-C, are operated in a coordinated manner to provide that the loudspeakers operate as a generally broad side firing array with beam steering. Signals applied to loudspeakers 13A-C are generally identical, but phase shifted with respect to one another to achieve line array operation with beam steering.

Each of channels 60A-E comprises a digital signal processor 61, an amplifier 63 and a loudspeaker, respectively loudspeakers 13A-C, 14 and 16. Matrix select controller 40 directs generation of a sound output either automatically or in response to operator interaction with the system using a graphical user interface 44 and, possibly, a local audio input 42 (such as a microphone). Generally only the lead locomotive of a tandem pair of locomotives 10 is allowed to use its loudspeakers, or at least its forward directed loudspeaker line array 12. Accordingly a slave/master circuit 45 is provided which supplies an enable/disable signal to the matrix select controller 40 depending upon whether a particular locomotive is the lead or a trailing machine.

Matrix select controller 40 may be programmed to respond to other inputs. Proximity sensor 58 may be a short range radar unit located with respect to the loudspeakers 13A-C, 14 and 16 which generates a disable/degrade signal in case a person is located in close proximity to the mouth of the waveguide from a loudspeaker unit. Output from a unit can be blocked or limited to prevent hearing damage to an individual standing in proximity to the unit. A telematics receiver unit 46 may be connected to the matrix select controller 40. Telematics units may be used to allow matrix select controller 40 to access geographic information system databases and maps allowing it to locate and characterize level grade crossings which the locomotive 10 is approaching. It may also be used to provide location information to the matrix select controller 40 as may a global positioning system (GPS) unit 50 installed on the locomotive 10 and connected to provide location data to the matrix select controller 40.

Timing of generation of a warning signal using the loudspeaker system of locomotive 10 depends on the speed and route which the locomotive is traveling. A speed signal source 48 may be provided or speed may be determined by GPS unit 50. The output generated by the system may be adjusted depending upon weather conditions 52, particularly wind direction, which can affect beam steering. Transponder trigger unit 54 communicates with crossing guard transponder 22 (if available) to determine if local conditions might be otherwise than indicated in the data base/look up table (LUT) 57 stored in memory 56.

Memory 56, and the LUT 57 relating to level grade crossings, is of particular relevance to control over the audio channels 60A-E. The database/LUT for level grade crossings is indexed by location and can include a topology classification, a risk factor index, a beam form type to use and a direction for aiming the beam/major lobe produced by the array 12 (which may be adjusted for wind). The beam profile to use may be further defined by amplitude to use, modulation and wafting of the signal. Alternatively, local transponders 22 may broadcast a crossing guard classification enabling the database to simply provide a beam profile to use for the general classification.

Once matrix select controller 40 has identified from a specific level grade crossing entry or type categorization a beam profile and warning alert type to use, and ambient conditions and locomotive 10 speed obtained, a configuration for each DSP 61 is available. The DSP configuration for each of channels 60A-E determines if a given channel is used at all, the delay for each channel, frequency shading filters to be implemented by each DSP to obtain a selected beam width and a gain for each channel's amplifier 63. A compressor limit may be implemented to shape audio waveforms to create higher average sound without exceeding peak to peak limits of the system. Signal strength can also be enhanced through other well known techniques such as passing more low frequency power (at the cost of beam spreading) or altering the harmonic content to affect human perception of the sound.

The active DSP system 61 for each horn could be replaced by modified "canned" tracks of the signal with the DSP filters applied to the waveform fed each respective horn. This would have the same effect as an active DSP but utilize independent processed and filtered tracks emulating the active DSP function without requiring the control DSP processing onboard.

Figure 9:
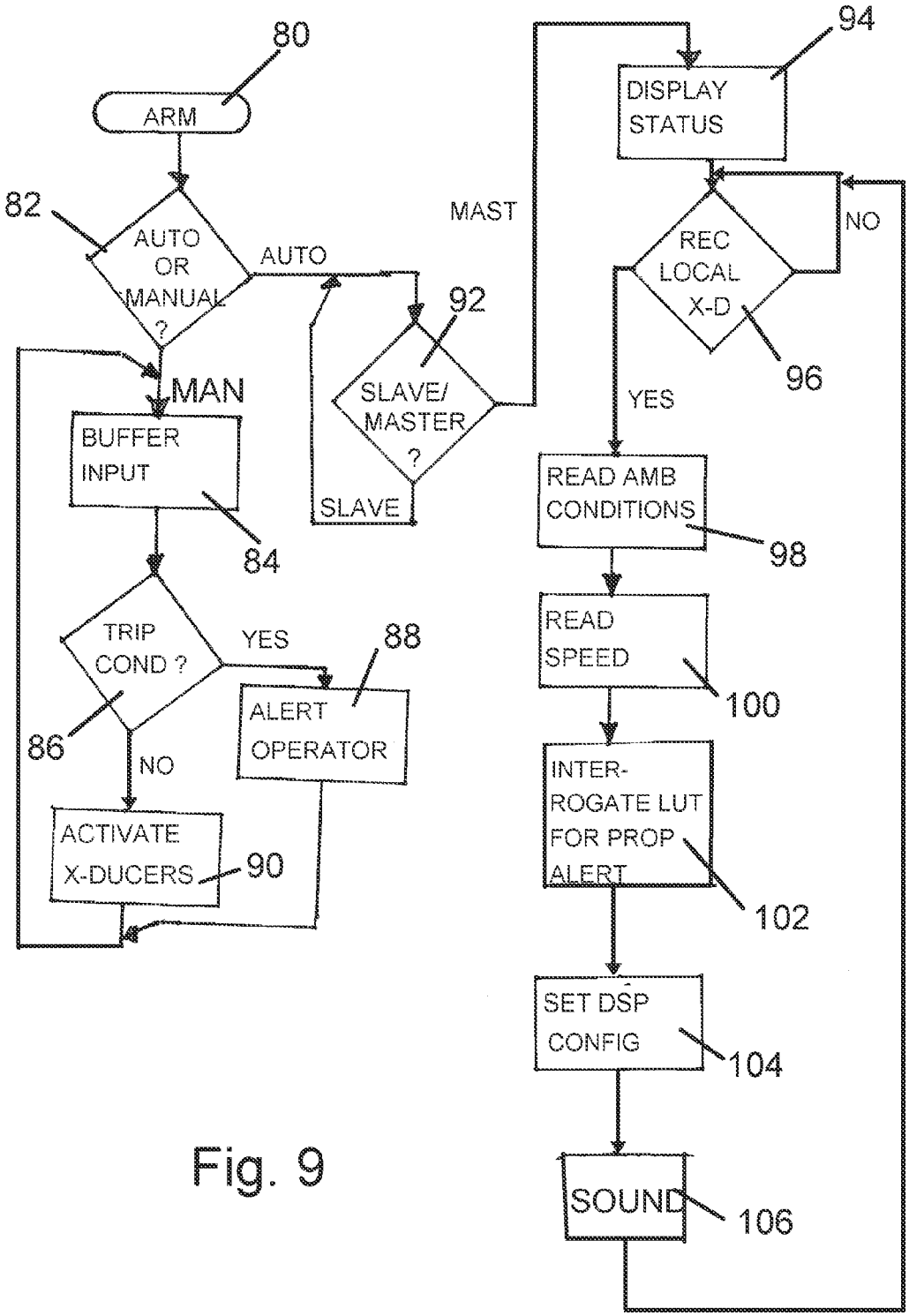
FIG. 9 is a high level flow chart for operation of the loudspeaker system.
Figure 10:
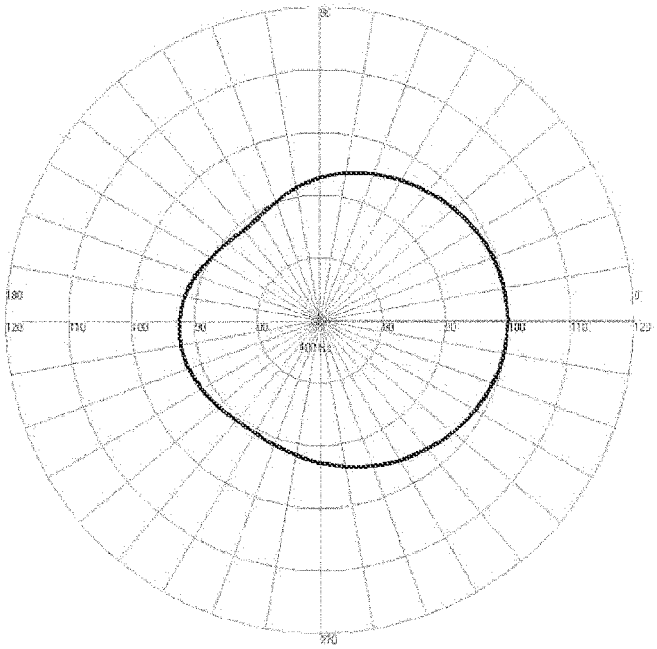
FIG. 10 is a polar plot of acoustic radiation emitted at 350 Hz for the front directed loudspeaker line array.
Figure 11:
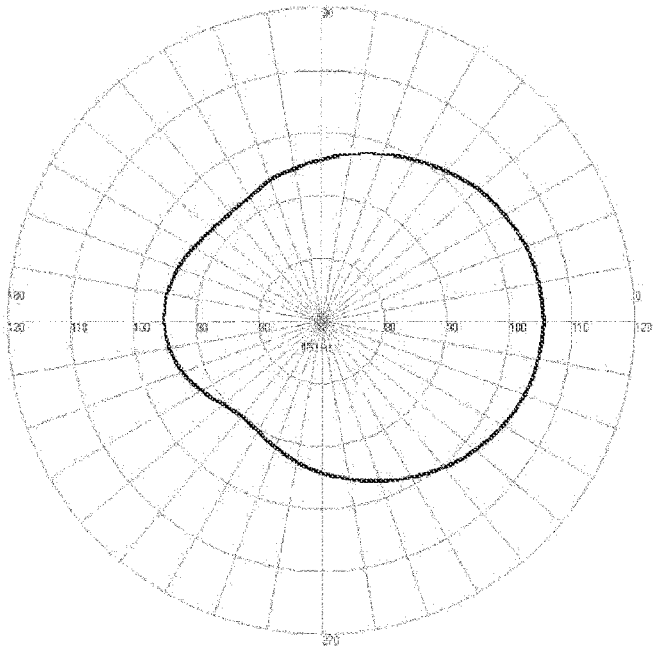
FIG. 11 is a polar plot of acoustic radiation emitted at 400 Hz for the front directed loudspeaker line array.
Figure 12:
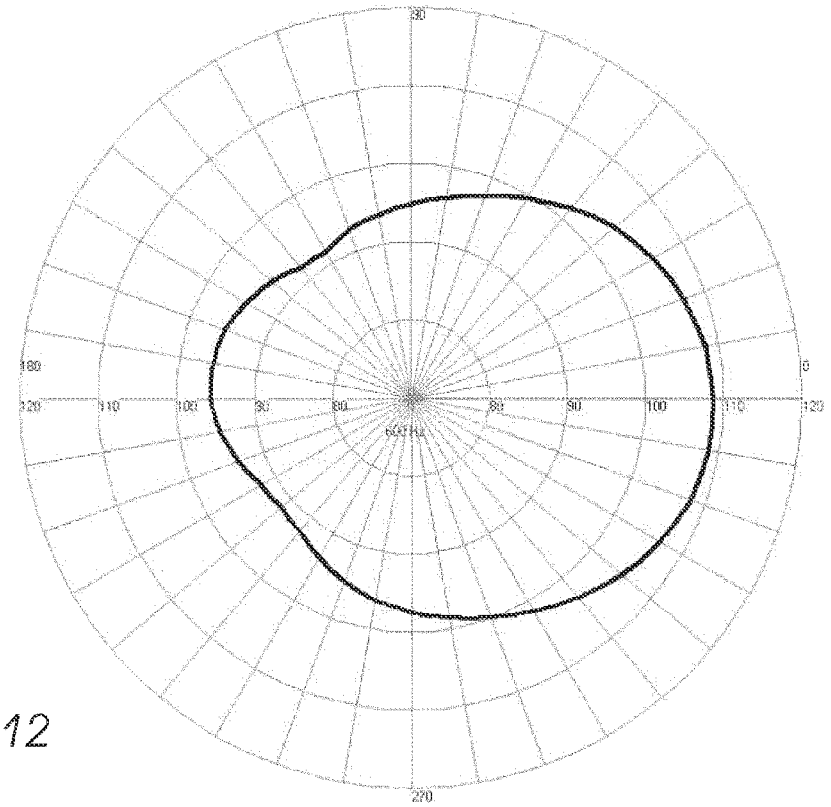
FIG. 12 is a polar plot of acoustic radiation emitted at 500 Hz for the front directed loudspeaker line array.
Figure 13:
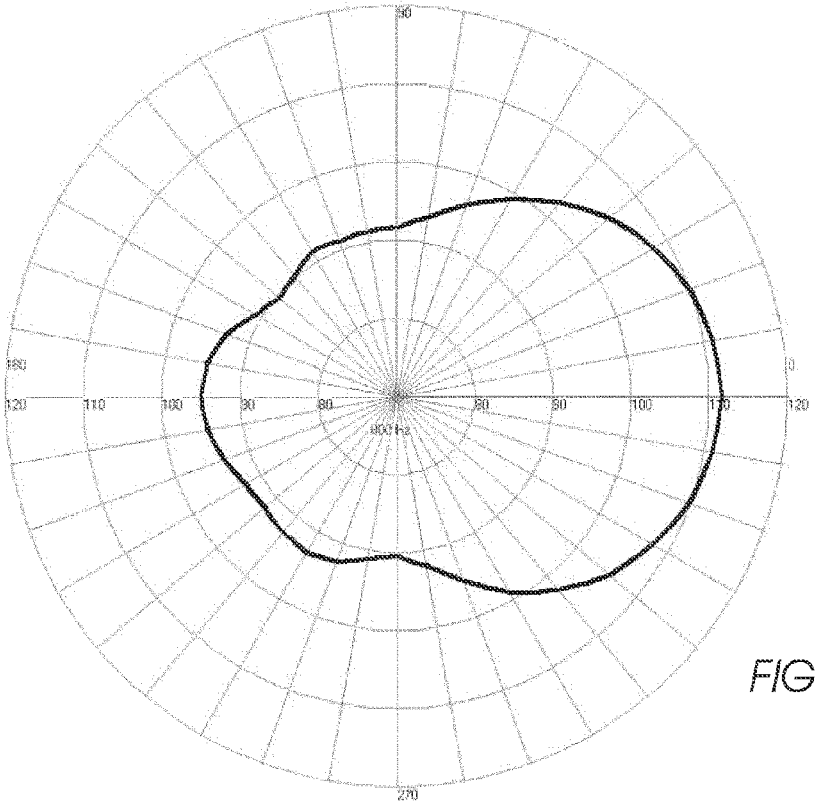
FIG. 13 is a polar plot of acoustic radiation emitted at 630 Hz for the front directed loudspeaker line array.
Figure 14:
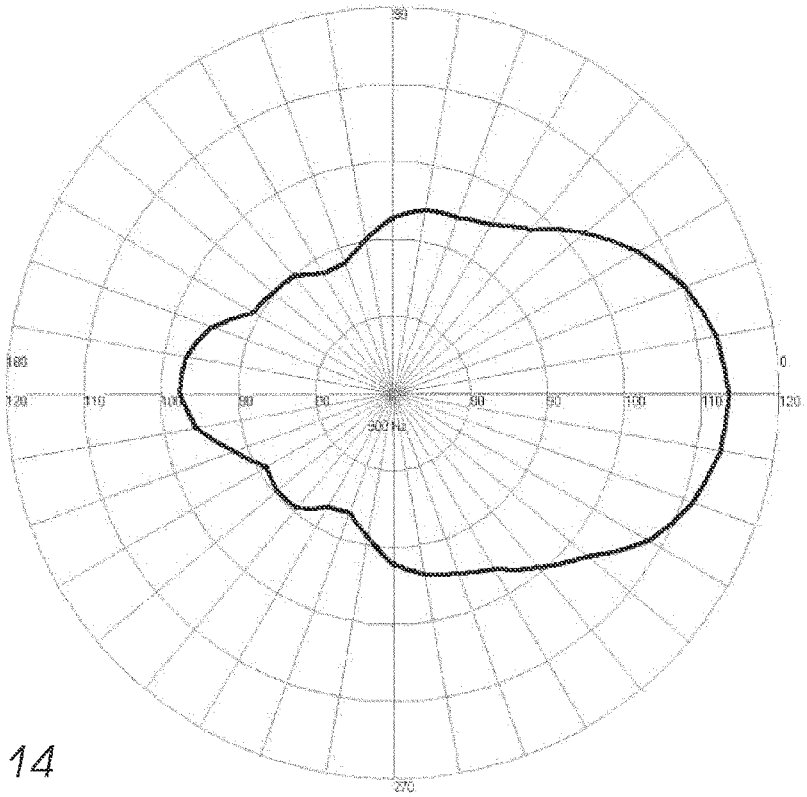
FIG. 14 is a polar plot of acoustic radiation emitted at 800 Hz for the front directed loudspeaker line array.
Figure 15:
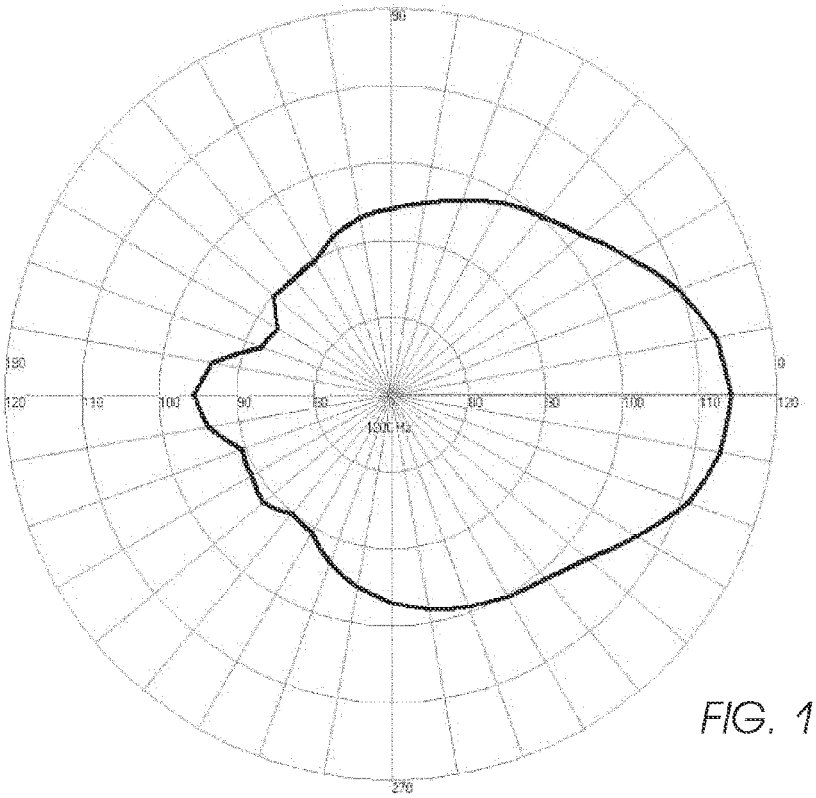
FIG. 15 is a polar plot of acoustic radiation emitted at 1000 Hz for the front directed loudspeaker line array.
Figure 16:
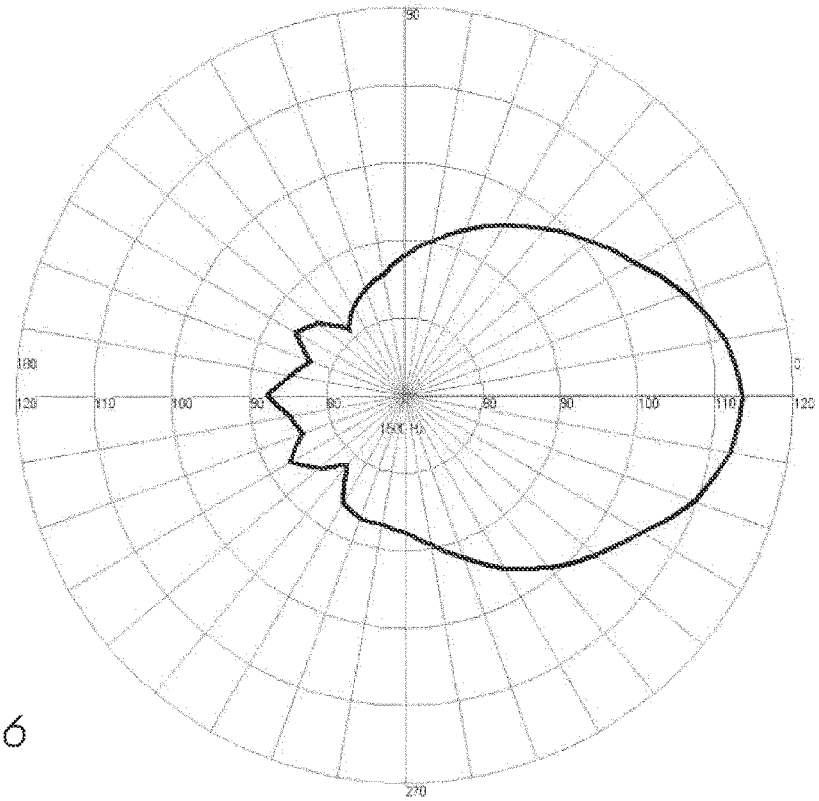
FIG. 16 is a polar plot of acoustic radiation emitted at 1250 Hz for the front directed loudspeaker line array.
Figure 17:
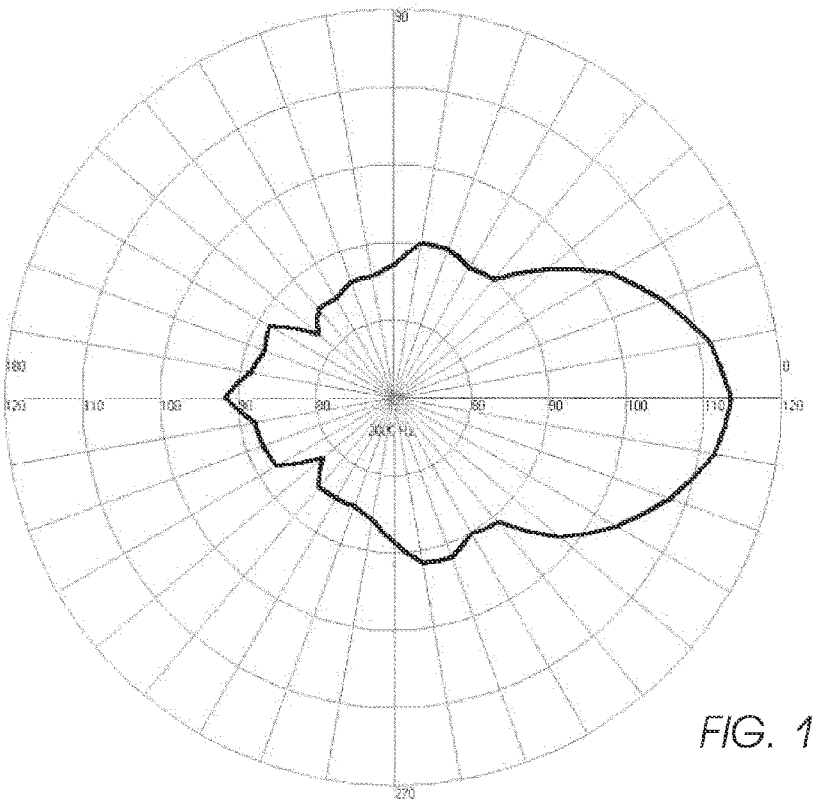
FIG. 17 is a polar plot of acoustic radiation emitted at 1600 Hz for the front directed loudspeaker line array.
Figure 18:
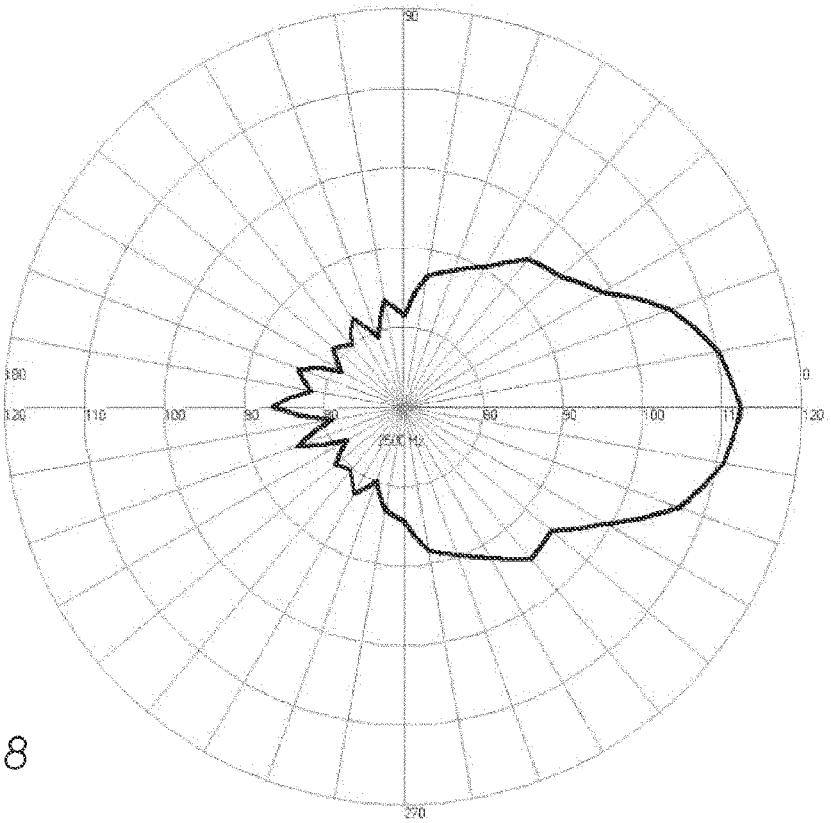
FIG. 18 is a polar plot of acoustic radiation emitted at 2000 Hz for the front directed loudspeaker line array.
Figure 19:
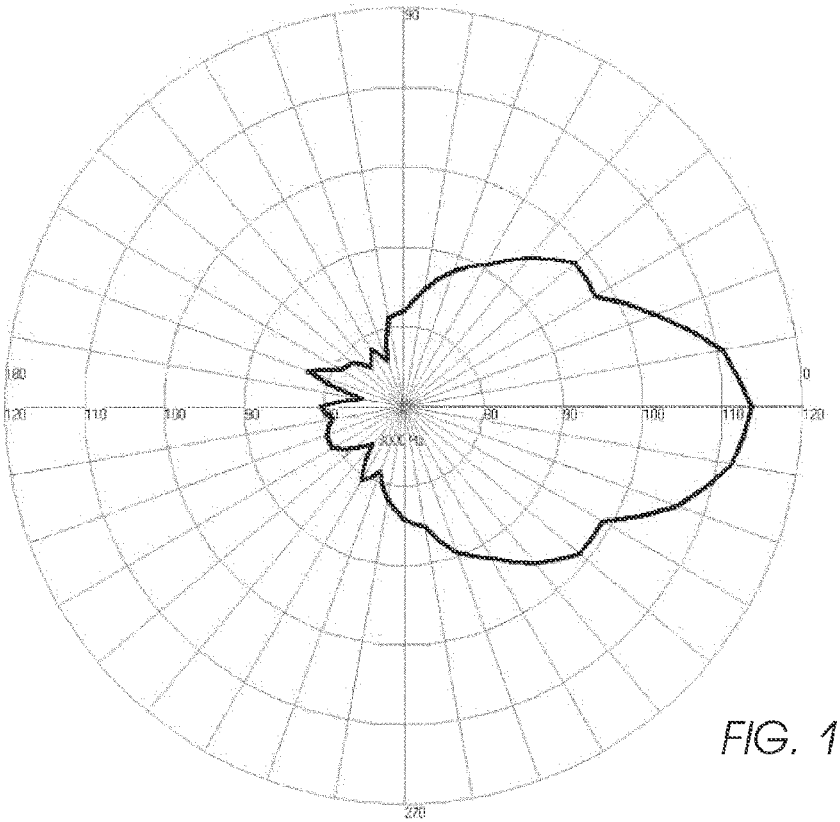
FIG. 19 is a polar plot of acoustic radiation emitted at 2500 Hz for the front directed loudspeaker line array.
Figure 20:
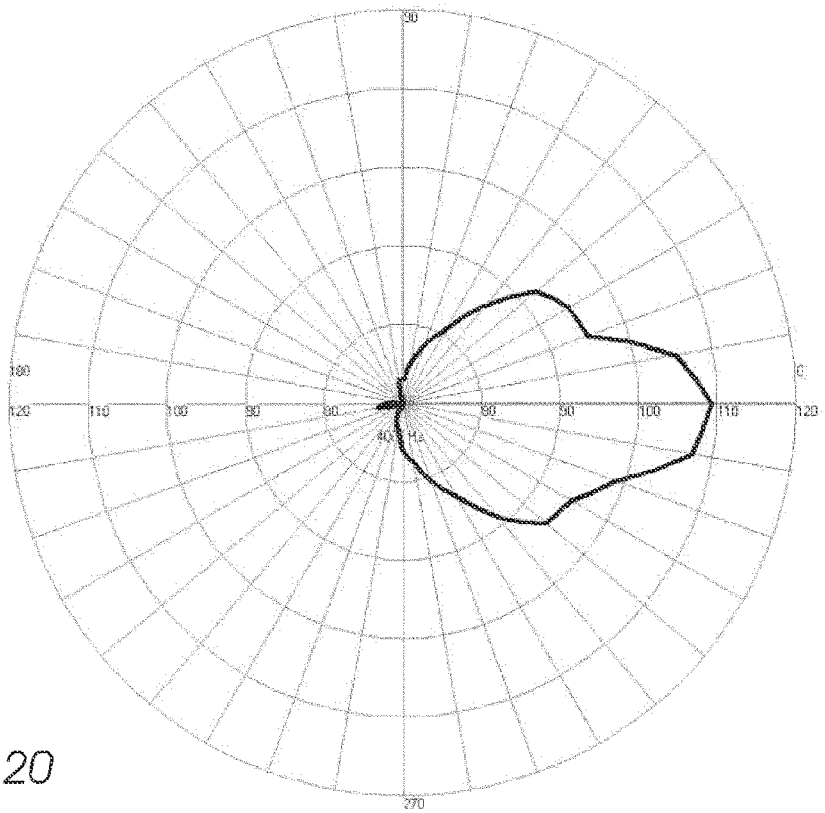
FIG. 20 is a polar plot of acoustic radiation emitted at 3150 Hz for the front directed loudspeaker line array.
Figure 21:
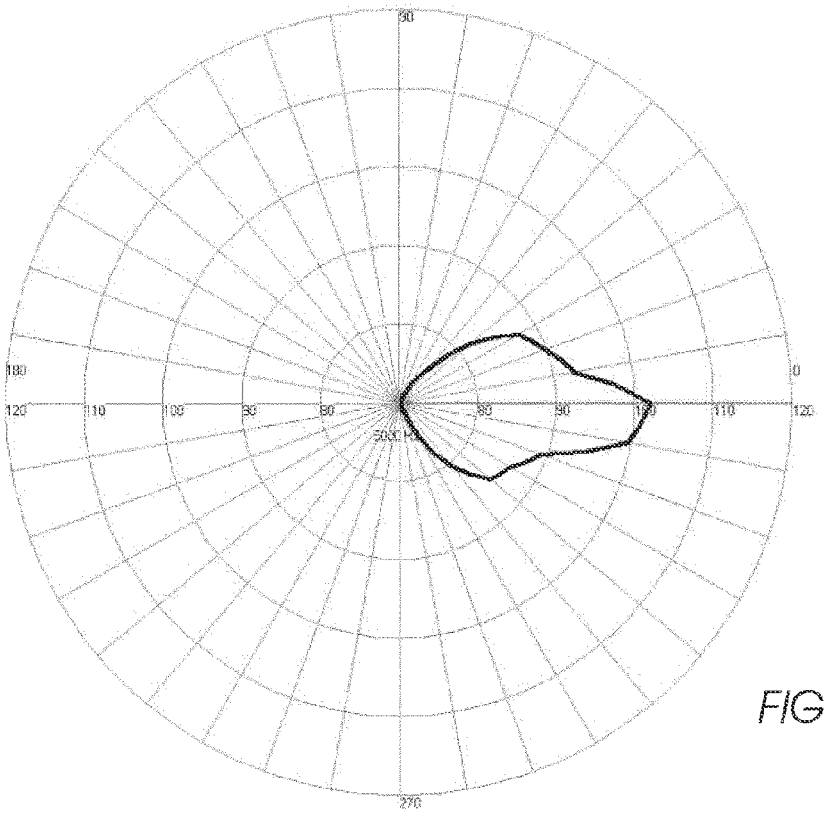
FIG. 21 is a polar plot of acoustic radiation emitted at 4000 Hz for the front directed loudspeaker line array.
Figure 22:
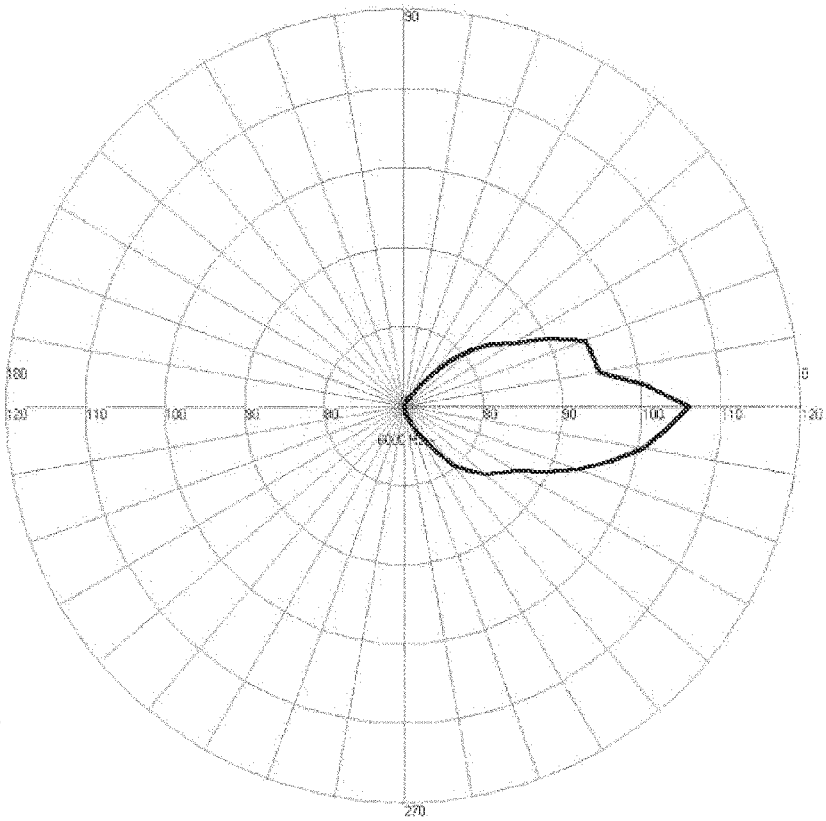
FIG. 22 is a polar plot of acoustic radiation emitted at 5000 Hz for the front directed loudspeaker line array.

The flow chart of FIG. 9 is a broad, high level depiction of this operation, occurring upon arming of the system by an operator at step 80. At step 82 the matrix select controller 40 determines if the system is in automatic or manual mode. If manual an audio input signal can be buffered at step 84. Next the presence of a trip condition, such as provided by proximity sensor 58 is checked for. If a trip condition is detected the operator is alerted (step 90) using the GUI 44 and operation returns to step 84 to continue buffering until the trip condition is cleared and the sound can be generated (step 88).

Under automatic mode it may be determined if the locomotive is a leader (master) or follower (slave), step 92). As long as the unit is a slave it may be disabled by looping the test. If the unit is a master its operational status is displayed (step 94) and approach to a level grade crossing is monitored, as may be indicated by a receiving a response to a transponder signal (step 96). Alternatively, GPS unit 50 may be used for this function through use of location signals to continually interrogate the LUT 58 for a match. Once approach to an crossing is indicated ambient conditions are read (step 98), speed of approach to the crossing is determined (step 100), the LUT 58 is interrogated to fetch the proper alert (step 102) and the several DSP units 61 have configurations set (step 104) allowing the audible warning signal to be generated (step 106) and the process loops back to step 96.

Figure 23:
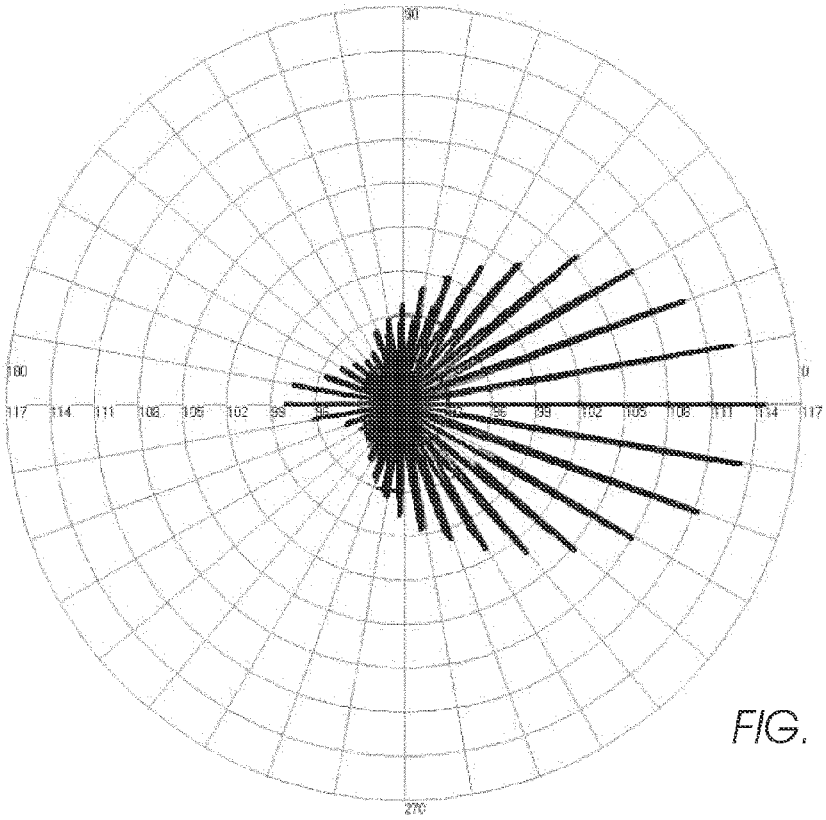
FIG. 23 is a polar plot of all frequency components for the front directed loudspeaker line array.

FIGS. 10-22 are polar plots relating to directivity data and frequency response of line array 12 taken at a plurality of frequencies, particularly 315 Hz, 400 Hz, 500 Hz, 630 Hz, 800 Hz, 1000 Hz, 1250 Hz, 1600 Hz, 2000 Hz, 2500 Hz, 3150 Hz, 4000 Hz, 5000 Hz. FIG. 23 is a composite view. A more distinct front directed major lobe appears with increasing frequency.

Figure 24:
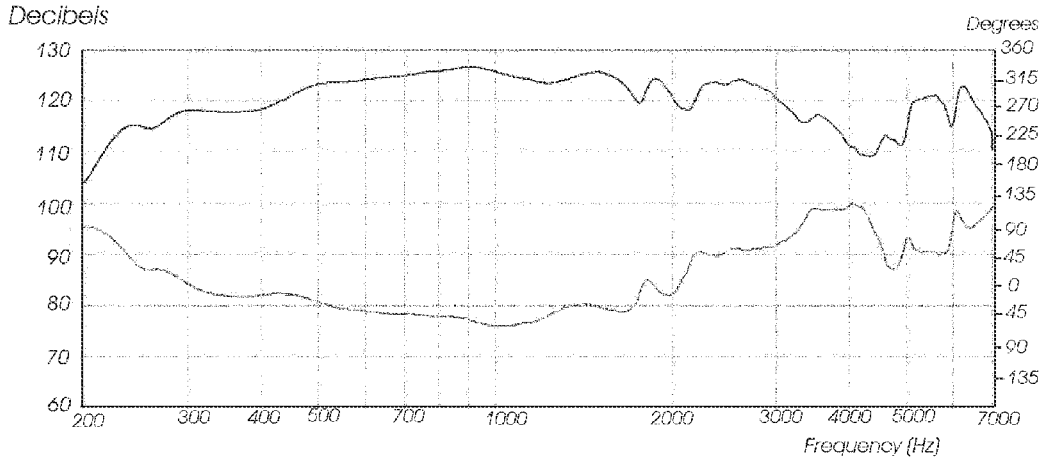
FIG. 24 is a pressure and phase response plot against frequency for the front directed loudspeaker line array.

FIG. 24 is a pressure and phase response plot against frequency for the front directed loudspeaker line array 12. The plots were generated from 1024 samples in 5.5 seconds. The frequency resolution was 35.1 Hz and the time resolution was 28.46 ms (32.16 feet).

Figure 25:
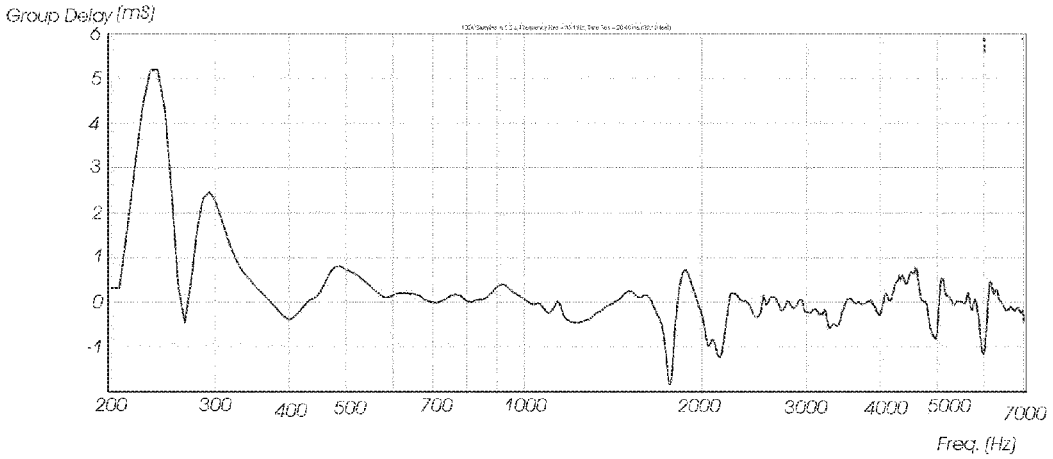
FIG. 25 illustrates delay against frequency for the line array.

FIG. 25 plots group delay against frequency at the same resolutions used in FIG. 24.

Figure 26:
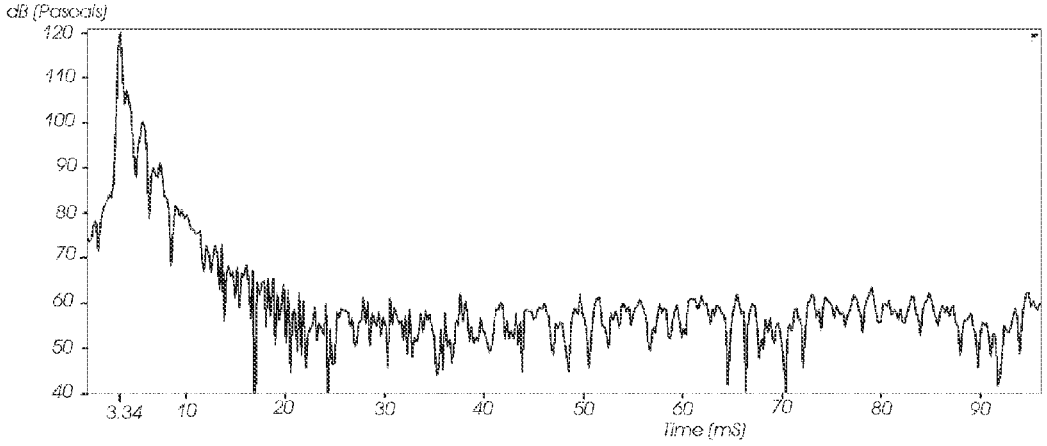
FIG. 26 is an energy over time response over all frequencies for the line array.

FIG. 26 is an energy over time response over all frequencies for the line array.

Figure 27:
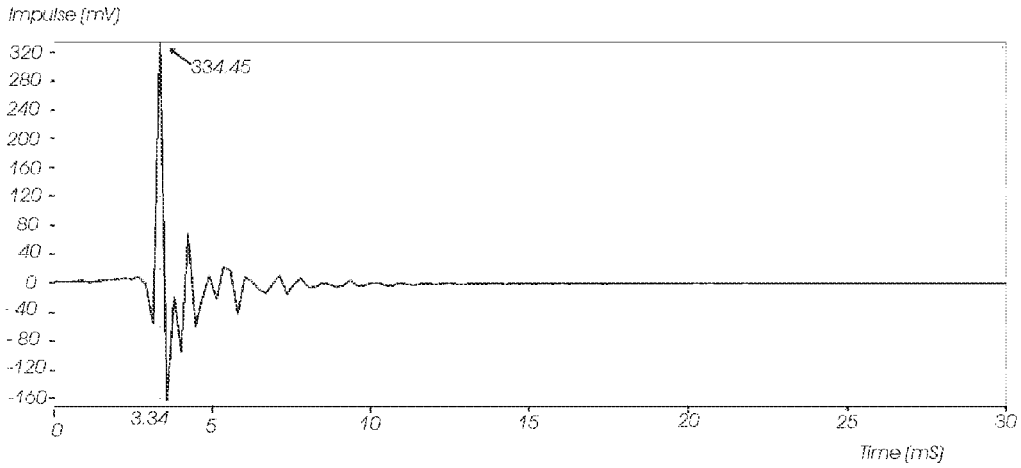
FIG. 27 is a response curve for a single impulse input over time for the line array.

FIG. 27 is a response curve for a single impulse input over time for the line array.

Figure 28:
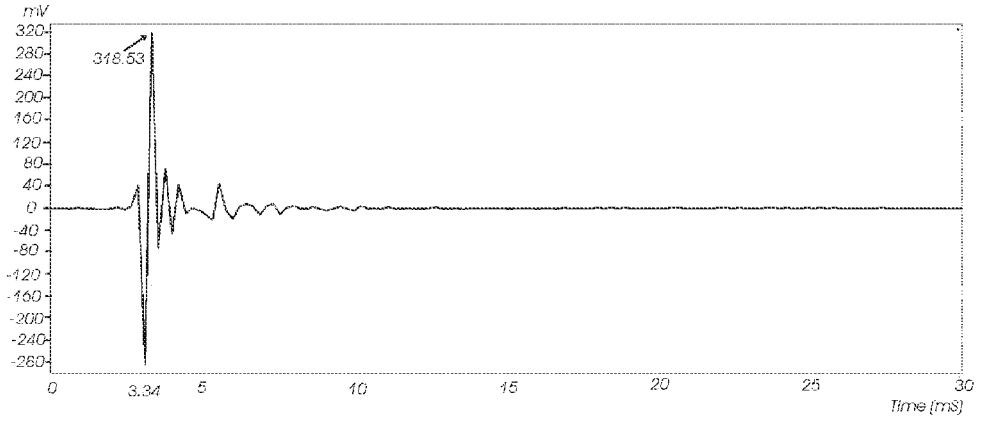
FIG. 28 is a response curve for a double impulse input over time for the line array.

FIG. 28 is a response curve for a double impulse input over time for the line array.

Figure 29:
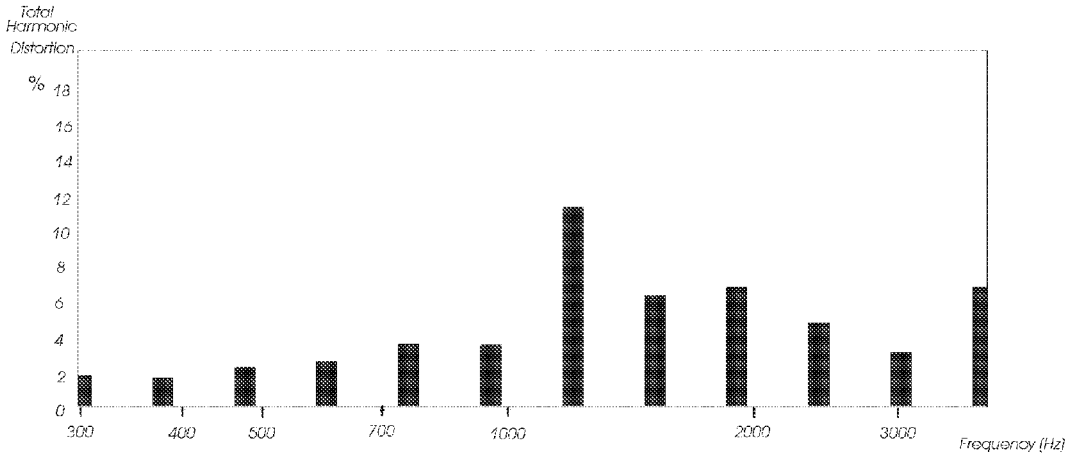
FIG. 29 is a graph of total harmonic distortion for the line array in terms of percentage for each frequency band.

FIG. 29 is a graph of total harmonic distortion for the line array in terms of percentage for each frequency band.

Figure 30:
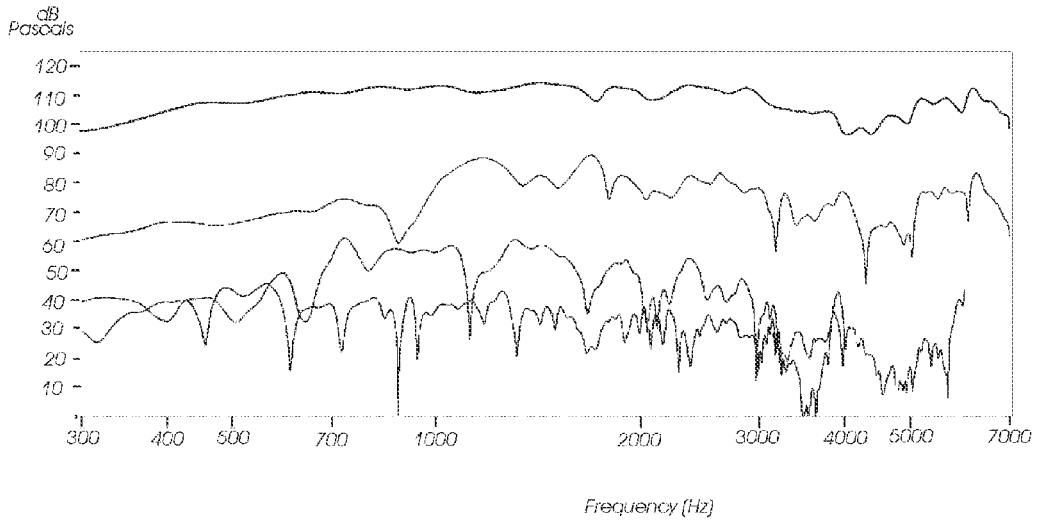
FIG. 30 is system frequency response with harmonic tracking overlay of second, third, fourth, fifth and sixth order distortion in decibels against frequency.
Figure 31:
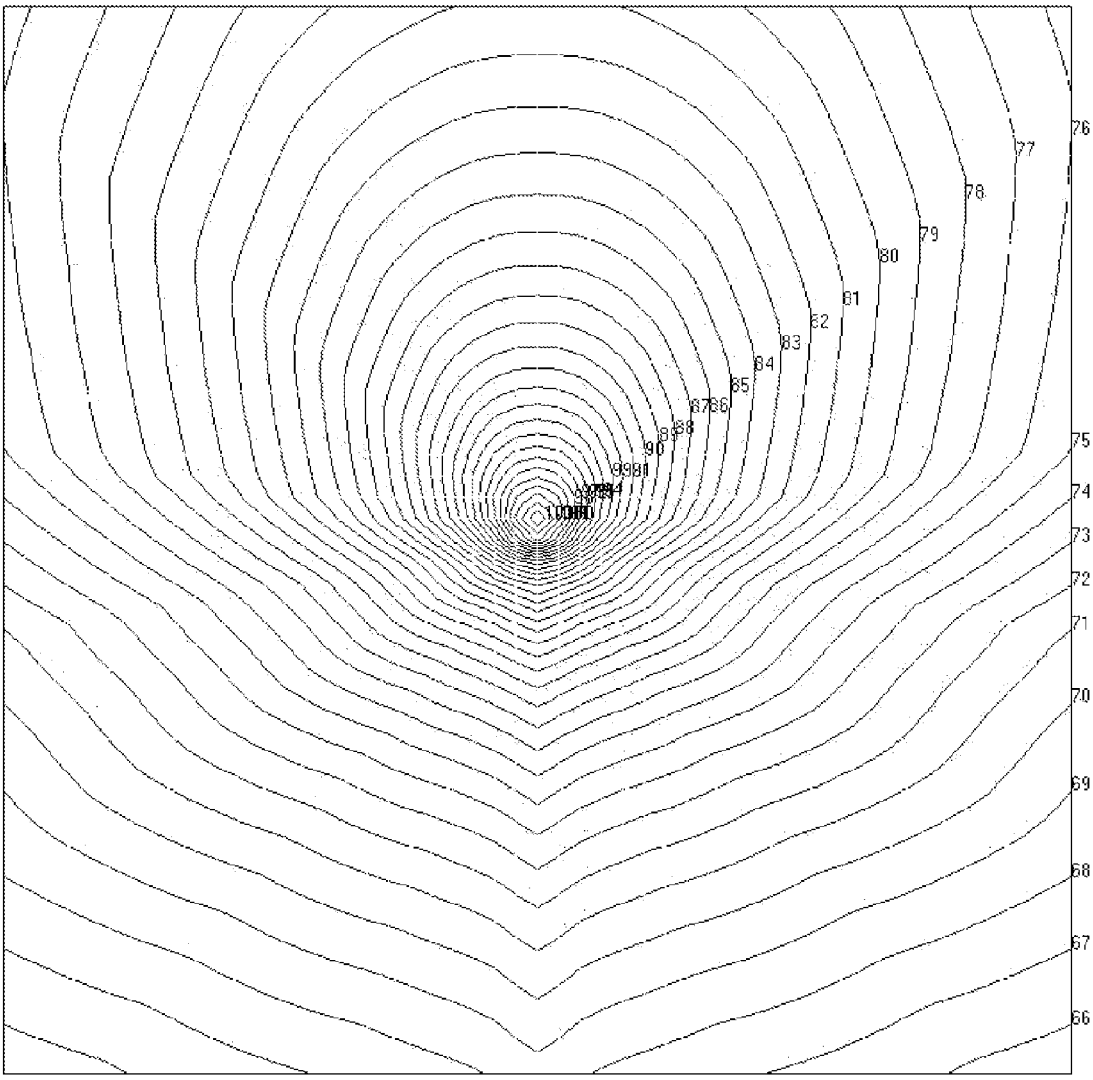
FIGS. 31-34 are directively patterns.
Figure 32:
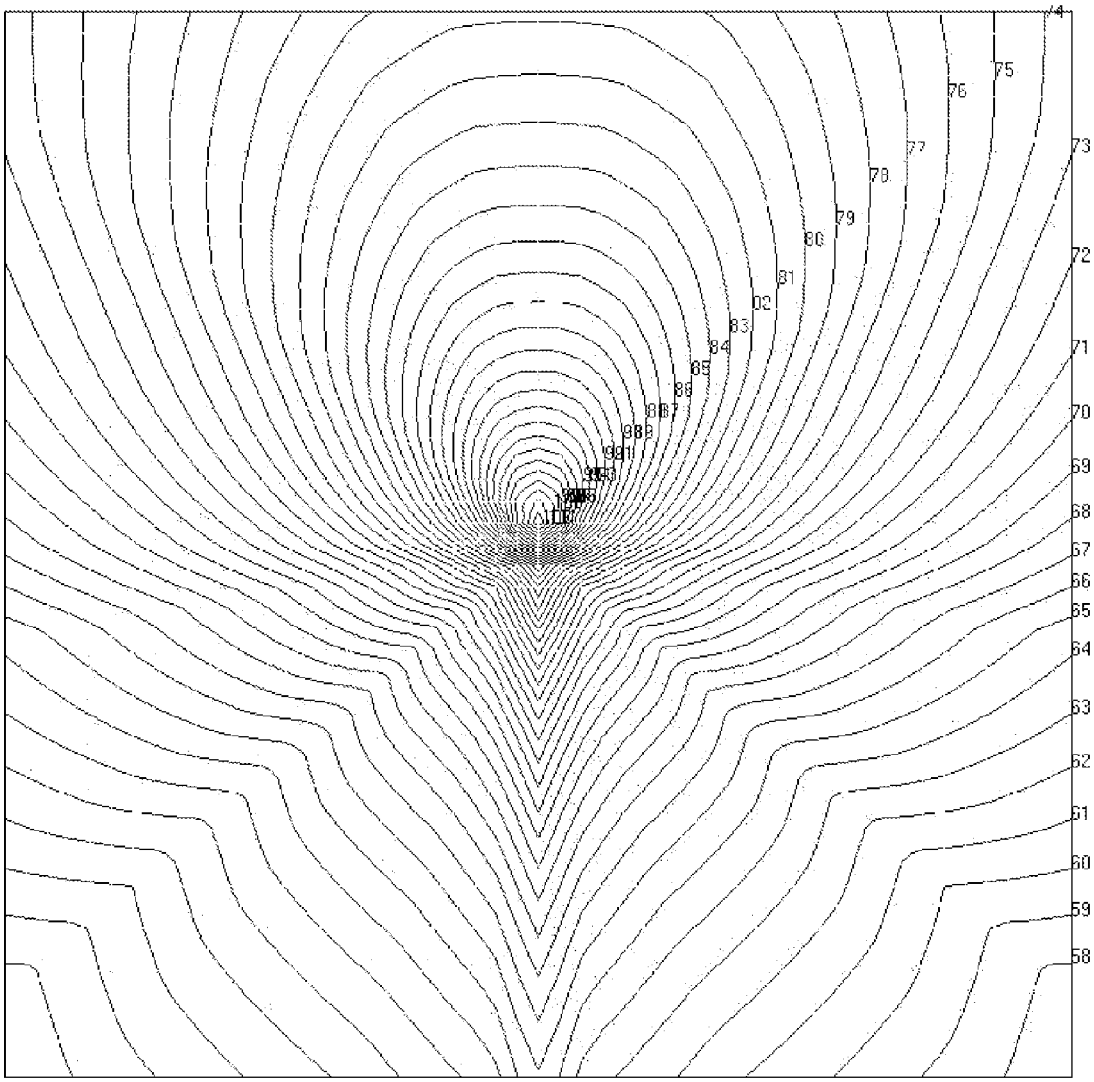
Figure 33:
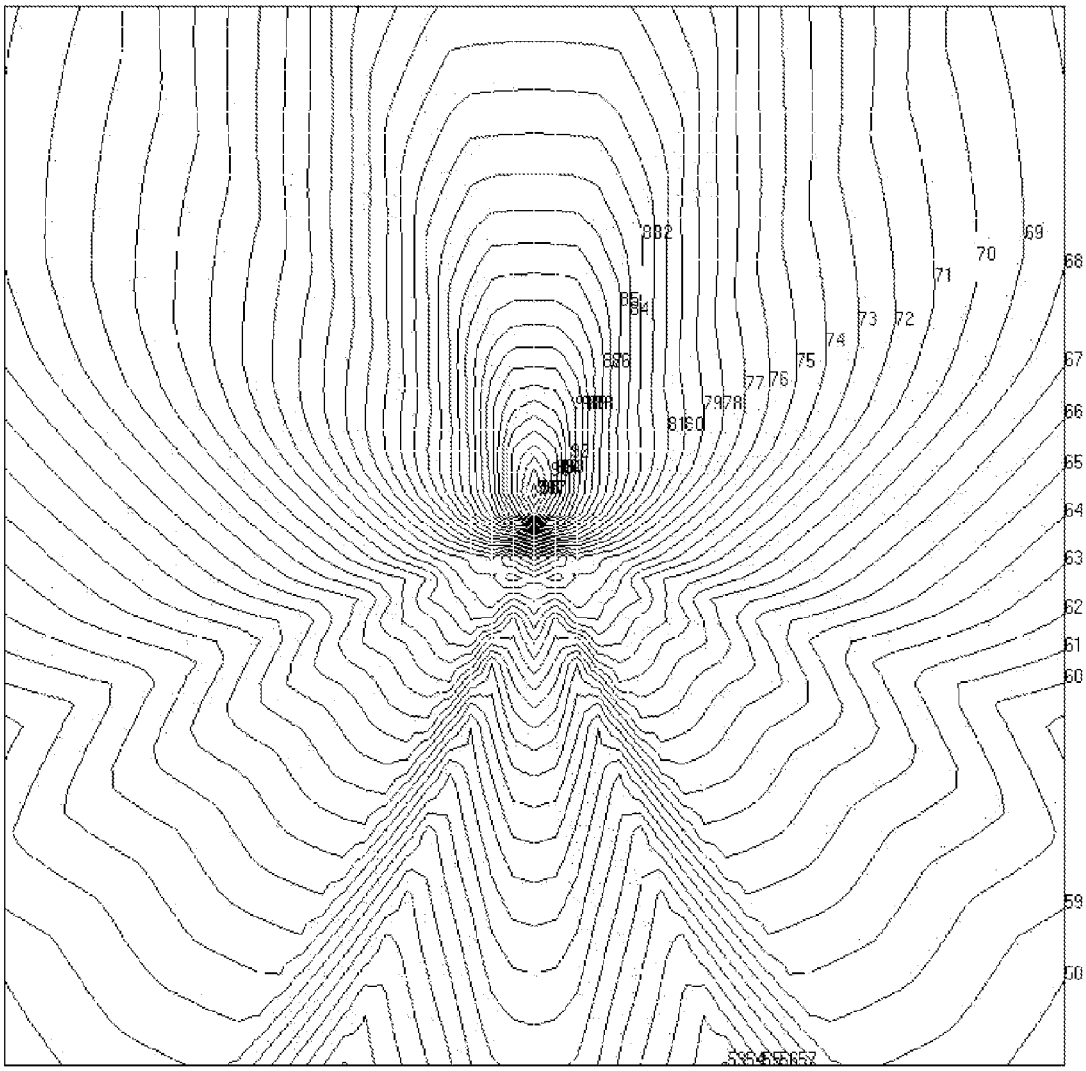
Figure 34:
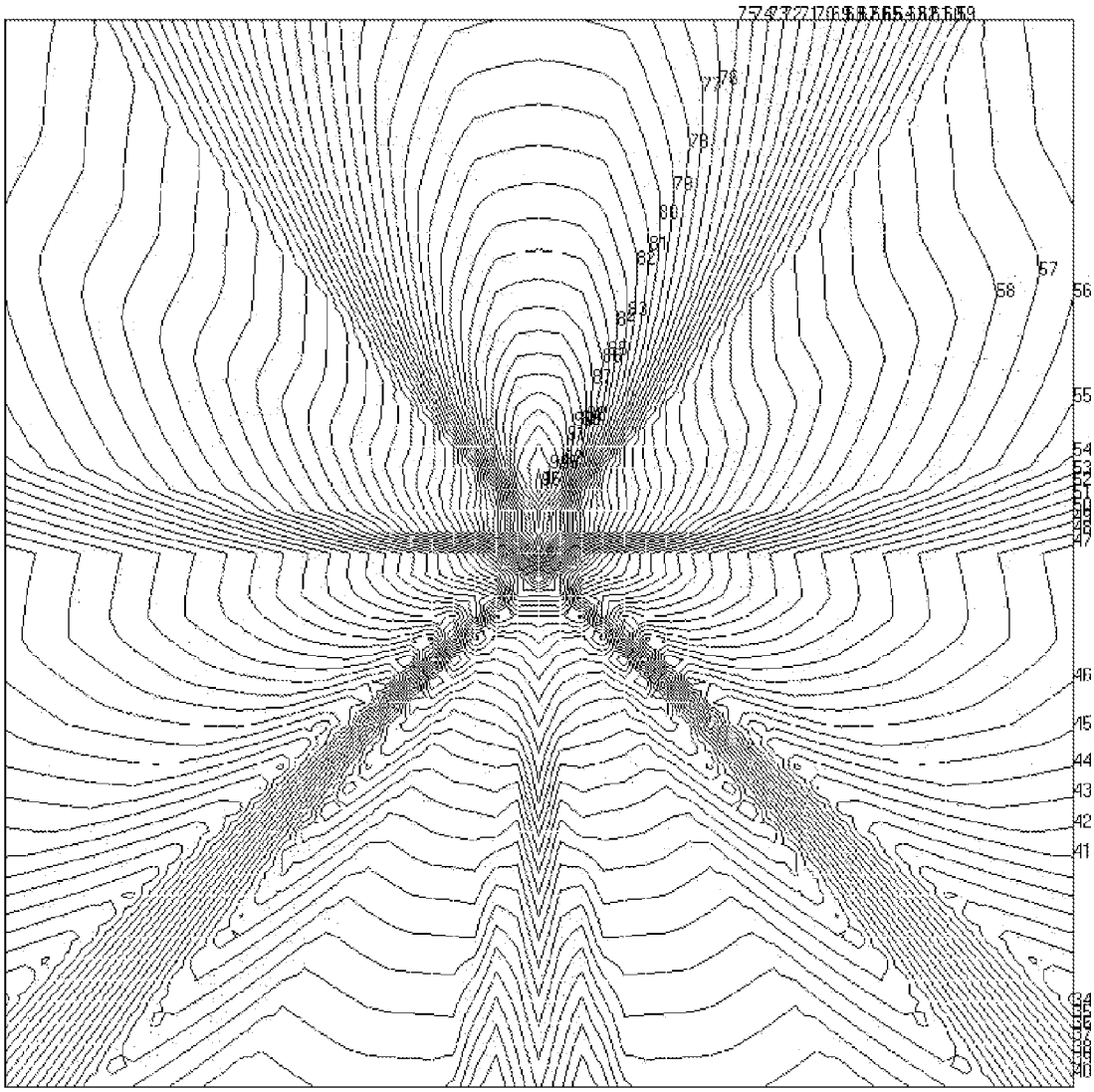
Figure 35:
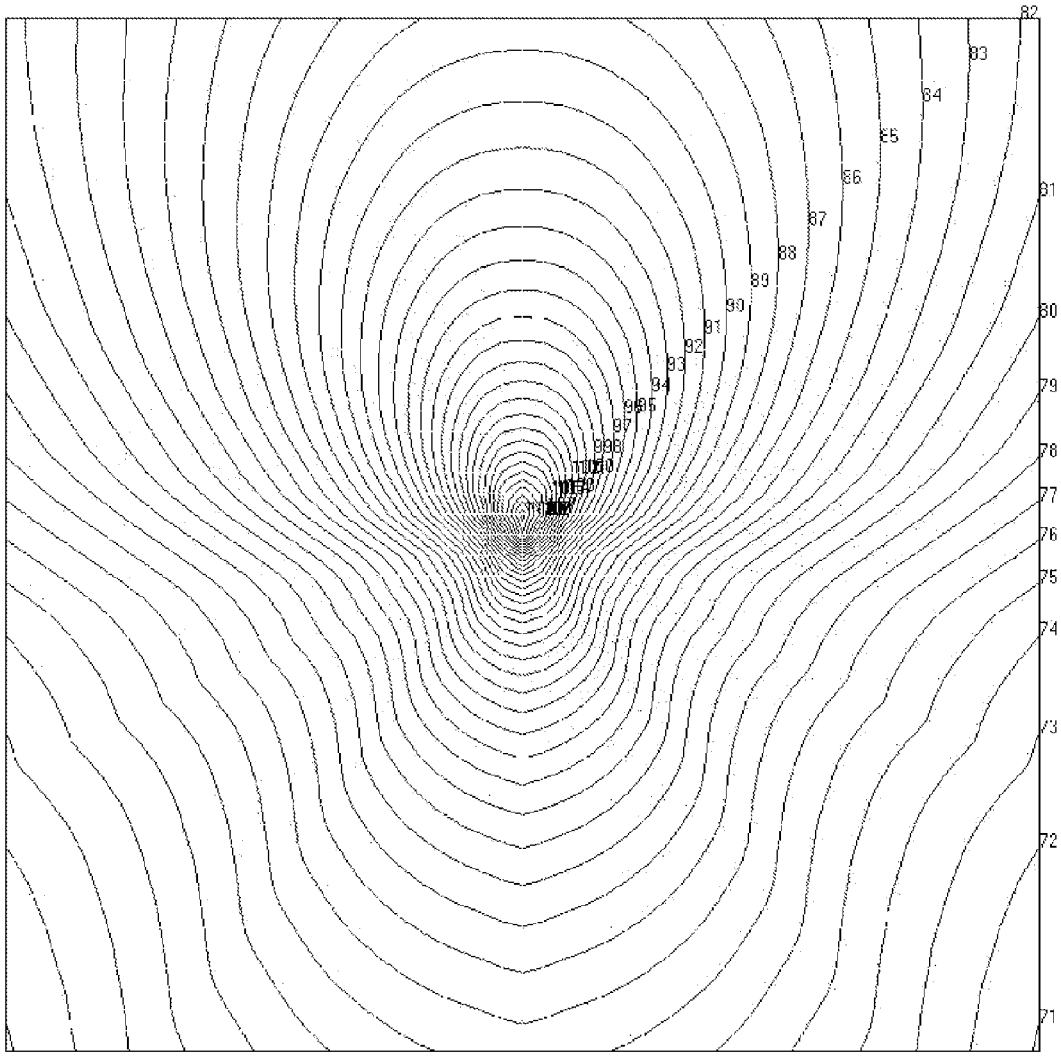
FIGS. 35-38 are exemplary directivity patterns.
Figure 36:
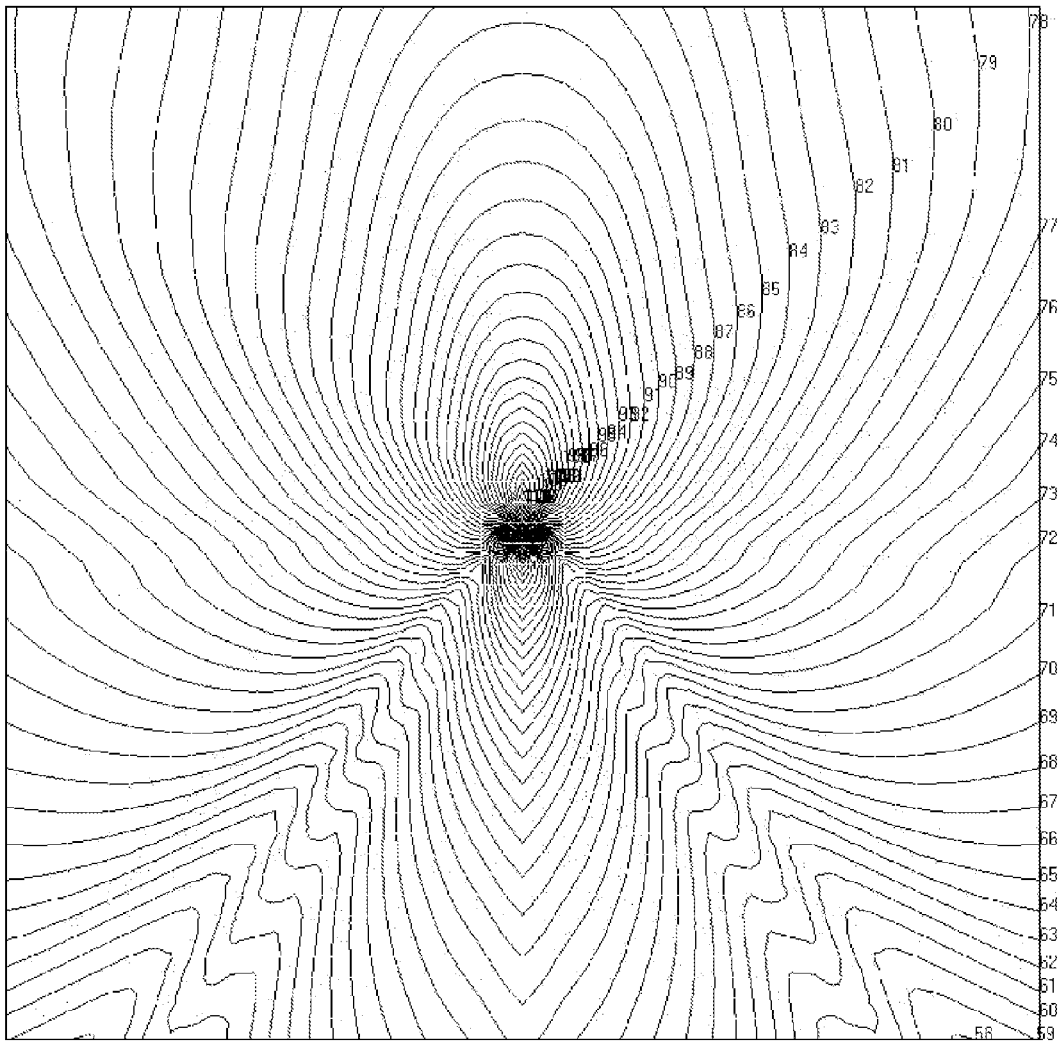
Figure 37:
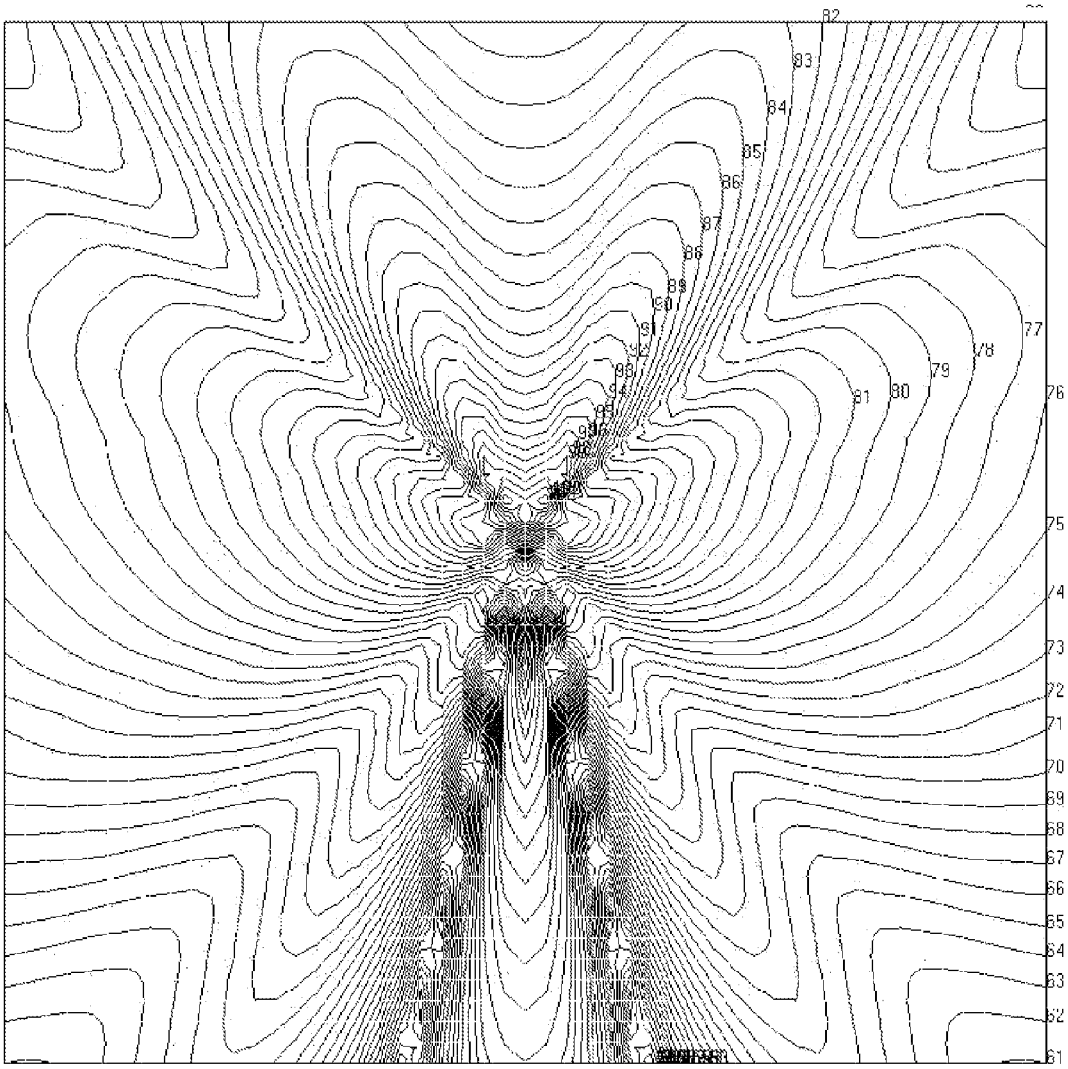
Figure 38:
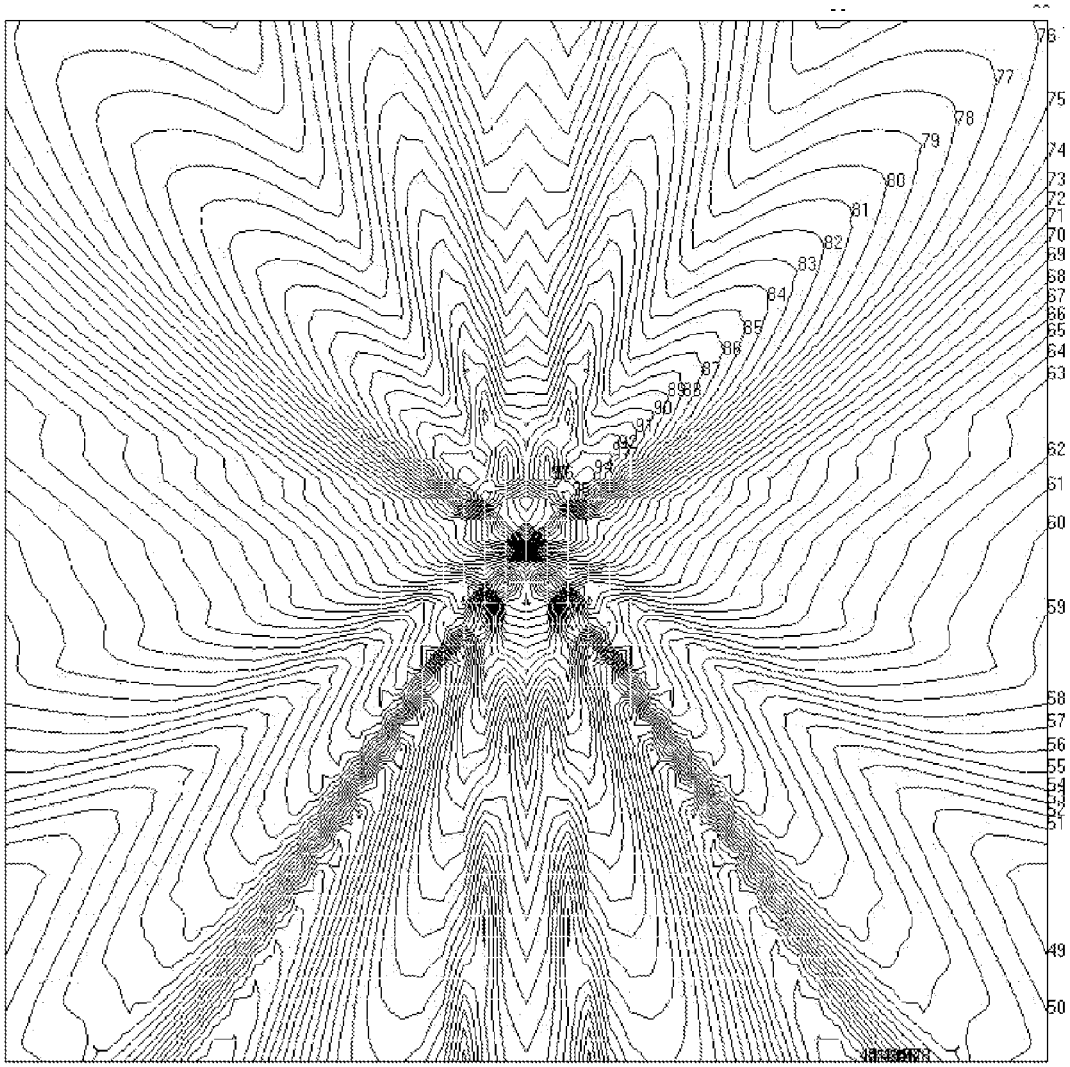

FIG. 30 is system frequency response with harmonic tracking overlay of second, third, fourth, fifth and sixth order distortion in decibels against frequency.

FIGS. 31 through 34 illustrate directivity of a free standing horn loaded loudspeaker such as loudspeakers 14, 16, or of line array 12 where only one loudspeaker is operated, such as loudspeaker 13B at the frequencies of 250, 500, 1000 and 2000 Hz.

FIGS. 35 through 38 illustrate directivity patterns over the same set of frequencies, 250 through 2000 Hz for line array 12 with all of loudspeakers 13A-C receiving the same drive signals. The drive signal applied to the center loudspeaker 13B is delayed by 1 millisecond in the bottom view for each frequency set. A delay is analogous to a phase delay except that the phase delay increases for each drawing pair due to the increasing drive signal frequency. Results at 500 and 1000 Hz indicate generation of extra lobes with suppression of a straight ahead primary lobe at 500 Hz.

Figure 39:
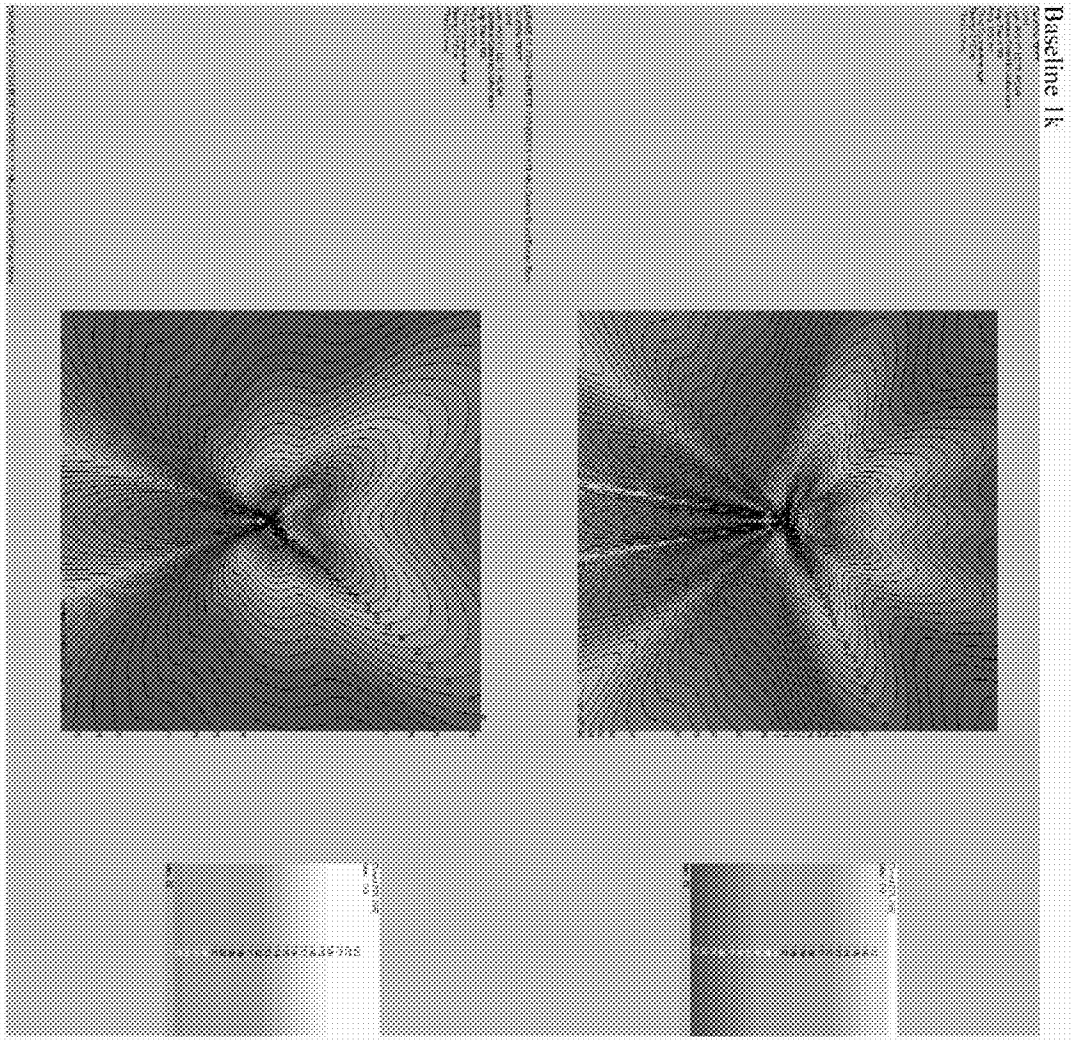
FIGS. 39-45 are still further exemplary directivity patterns illustrating operation of the train mounted line array.
Figure 40:
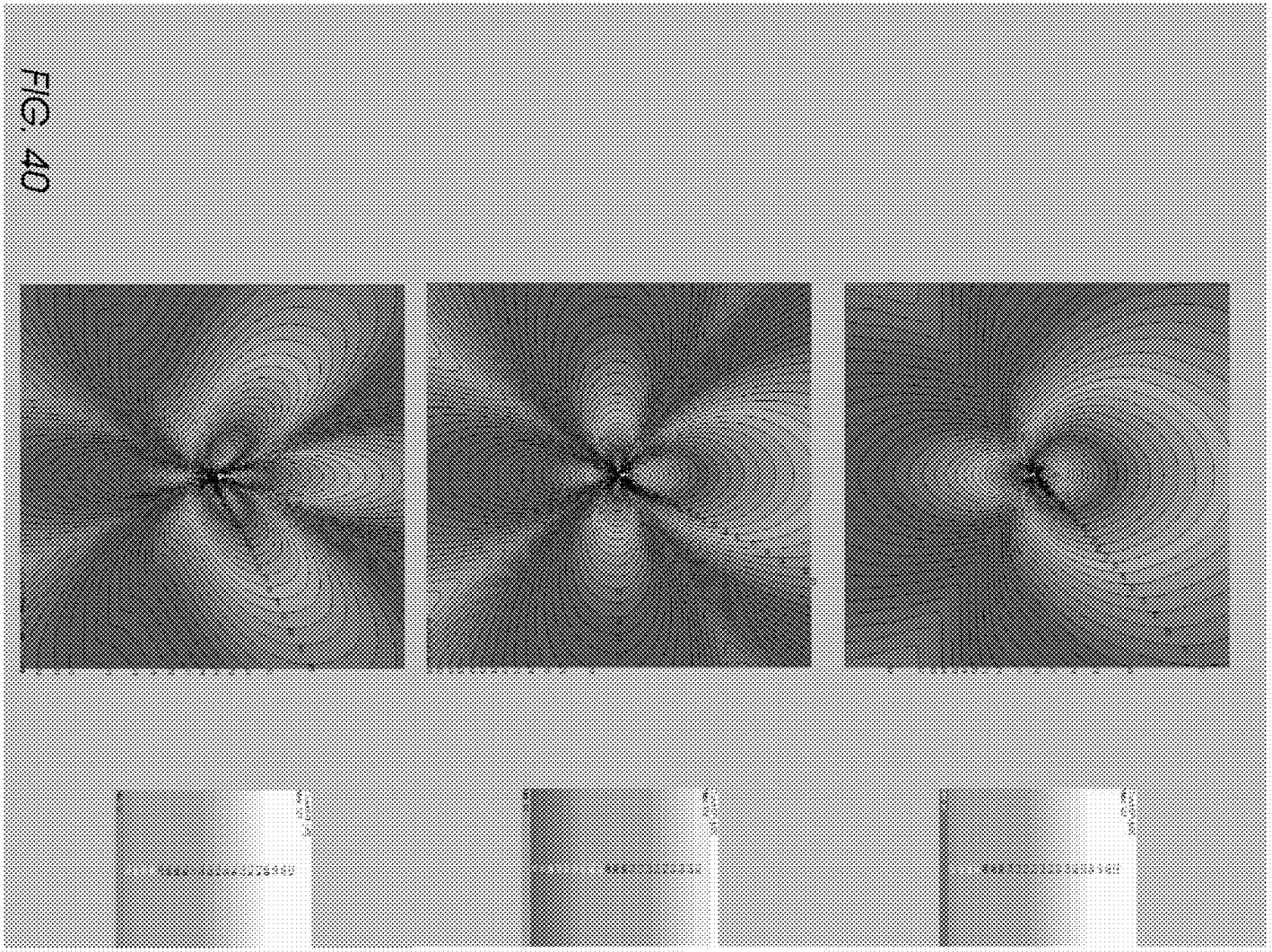

FIGS. 39 through 45 illustrate the use of delay and amplitude and/or frequency shading to shape sound lobes from a line array 12 and to steer the resulting lobes/beams. FIG. 39 is a pair of polar graphs with baselines for the top directivity pattern at 1000 Hz and at 500 Hz, respectively. FIG. 40 includes three directivity patterns. The top pattern is a pattern for a horn emission frequency of 250 Hz with center horn loaded loudspeaker 13B of the line 12 delayed 1.1 milliseconds. The middle and bottom patterns are for 250 and 500 Hz. At 250 Hz the line array 12 exhibits a pronounced forward lobe, two side directed lobes and a very small rearward lobe. At 500 Hz the rearward directed lobe substantially disappears and the pair of left and right side lobes are folded forward and gain intensity. The forward major lobe is attenuated in comparison.

Figure 41:
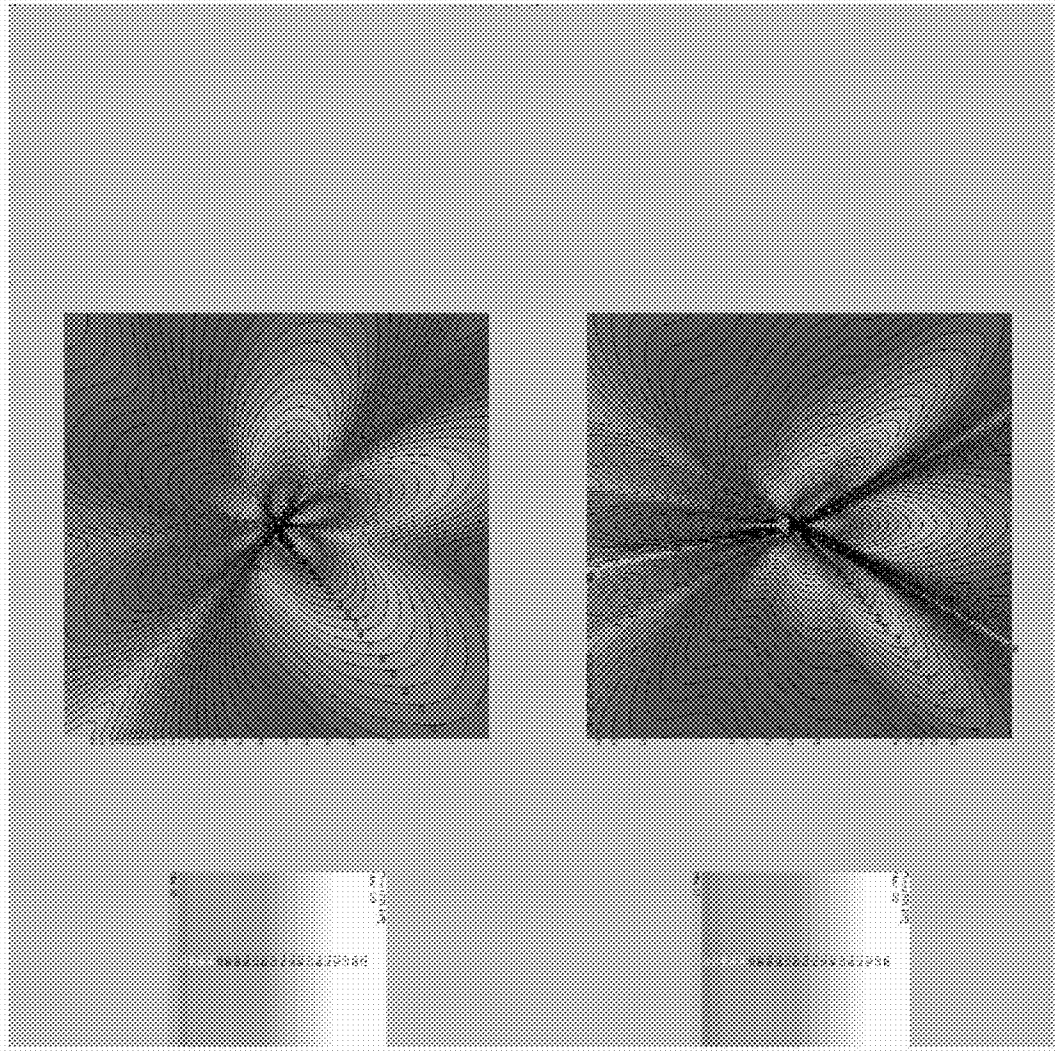

FIG. 41 relate to directivity patterns at 1000 Hz (top) and 500 Hz (bottom) with differentiated delays applied to the center and the rightside of the side loudspeakers relative to the remaining side loudspeaker, respectively. The delays are 0.5 & 1 ms. At 500 Hz the lobes are canted to the left and the right most lobe increases in strength relative to the left and forward lobes.

Figure 42:
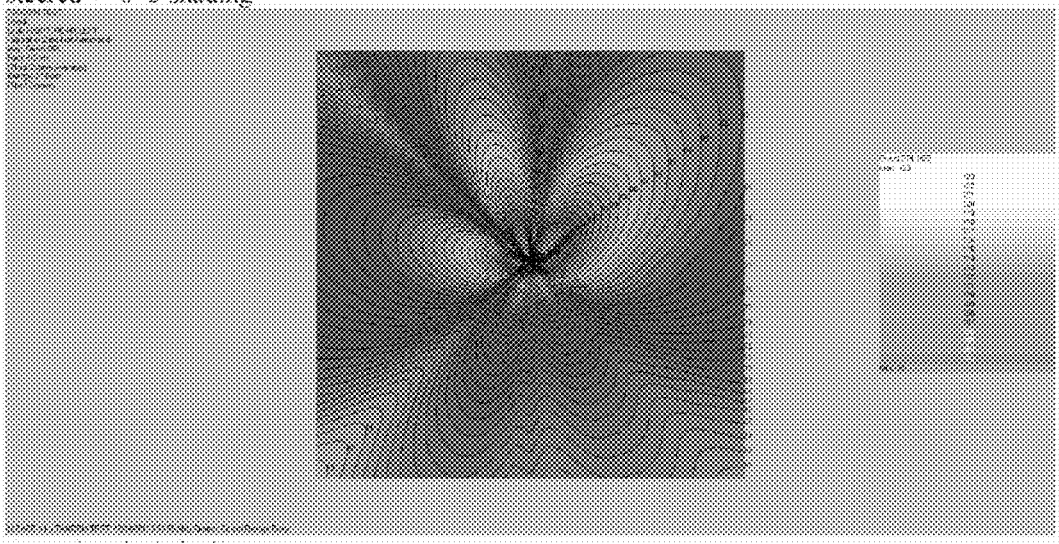
Figure 43:
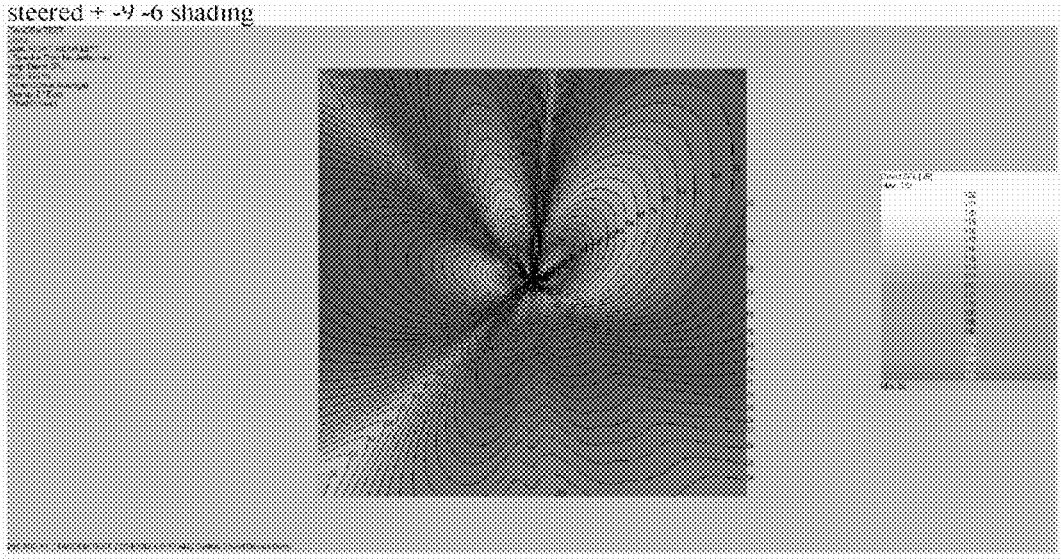

FIG. 42 is labeled "steered+−6 −3 shading." The directivity pattern is for an emission frequency of 500 Hz and reflect 0.5 millisecond and 1.0 millisecond delays to the center and right loudspeakers of a three speaker line array 12. The output of the center and left loudspeakers is attenuated. The center speaker is attenuated −6 db and the left loudspeaker is attenuated −3 db. In FIG. 43 the attenuation is increased −9 db for the center and −6 db for the left. This illustrates the use of selective amplitude shading to achieve substantial lobe steering and shaping.

Figure 44:
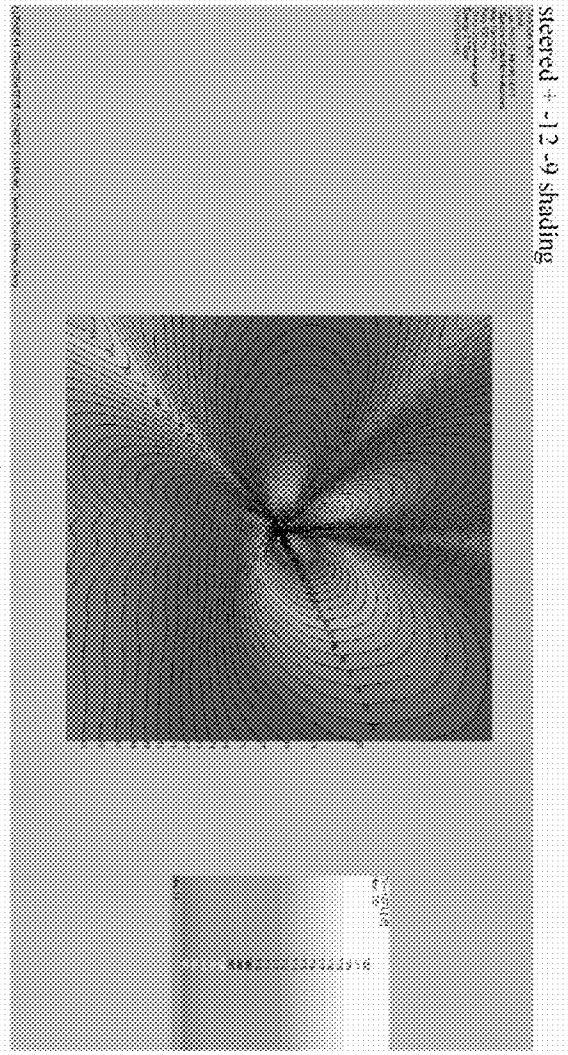
Figure 45:
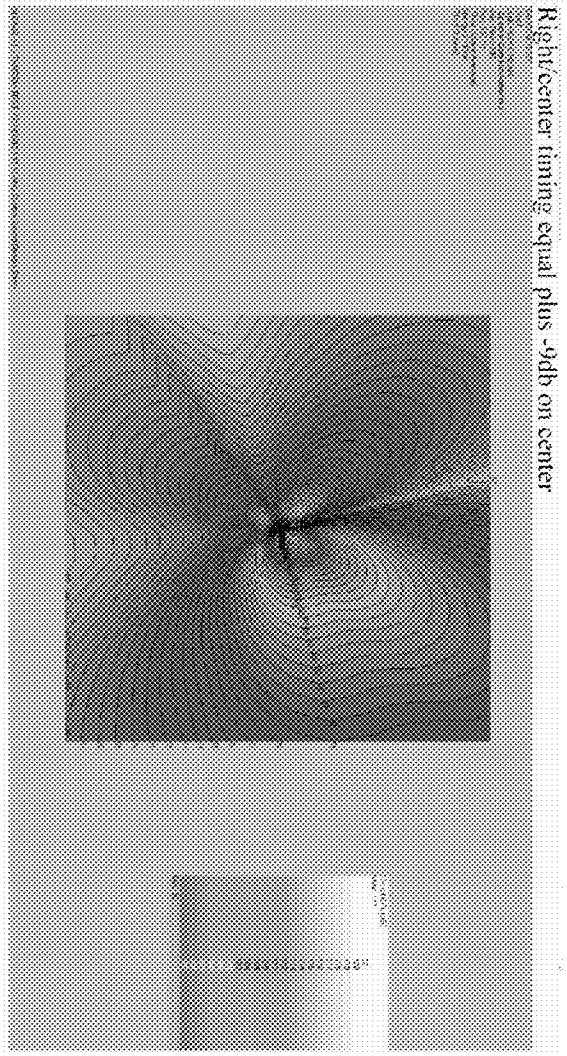

FIG. 44 is labeled "steered+−12 −9 shading." It is also for 500 Hz. The center loudspeaker is attenuated by −12 db and the left by −9. The phase relationship is set by a center 0.5 msec delay and a right speaker delay of 1 msec. In FIG. 45 the center loudspeaker is attenuated by −9 db and the left loudspeaker is shut off. There is no delay of the right loudspeaker with respect to the left.

What is claimed is:

1. A sound system for a ground vehicle comprising:

a line array of loudspeakers installed on the ground vehicle to allow broadside firing from the line array to project a sound beam forward from the vehicle along a direction of travel of the vehicle;

first and second loudspeakers installed on the ground vehicle for projecting sound to the sides of the ground vehicle;

a control system for applying drive signals to the loudspeakers of the line array and to the first and second loudspeakers, the control system being configured to provide an adjustment of drive signals applied to each loudspeaker of the line array thereby controlling side to side directional steering of the sound beam and, the control system being further configured to control a beam width of the sound beam; and automated, location dependent means for selecting the beam width and directional steering of the sound beam generated by the line array.

2. The sound system of claim 1, the ground vehicle being a railroad locomotive.

3. The sound system of claim 2, further comprising:

the automated, location dependent means including a database of level grade crossings indexed by location; and means for determining location of the railroad locomotive.

4. The sound system of claim 3, the database of level grade crossings further comprising:

a beam profile for generation by the line array including width and direction; and adjustment of the drive signals including relative phase adjustment and signal strength adjustment.

5. The sound system of claim 4, further comprising: means responsive to local weather conditions for further steering beam direction.

6. The sound system of claim 2, the automated, location dependent means further comprising:

means of communication between a crossing guard controller and the control system which becomes active responsive to approach of the locomotive to a level grade crossing; and a specification for beam width and direction to be projected from the line array for communication from the crossing guard controller and the control system for the sound system.

7. The sound system of claim 6, further comprising: means responsive to local weather conditions for further steering beam direction.

8. A railroad crossing guard system comprising:

a directional sound system installed on a locomotive for producing a sound beam;

a control system for activating the directional sound system, selecting a width of the sound beam and steering the sound beam; and the control system including automated, location dependent means for selecting a direction in which the sound beam is steered and for selecting the width of the sound beam dependent upon the location.

9. The railroad crossing guard system of claim 8, further comprising: the directional sound system including a line array of loudspeakers, the line array being mounted with a default sound projection axis aligned on a longitudinal axis of the locomotive and directed forward from the locomotive.

10. The railroad crossing guard system of claim 9, the automated, location dependent means further comprising:

a global positioning system unit for determining locomotive location;

a database of level grade crossings indexed by location; and means for interrogating the database responsive to determined locomotive location.

11. The railroad crossing guard system of claim 10, further comprising:

the database providing for a least a first level grade crossings a profile for a sound beam to be projected from the line array defined in terms of direction of its projection centerline.

12. The railroad crossing guard system of claim 11, further comprising:

means responsive to weather conditions for further steering the sound beam.

13. The railroad crossing guard system of claim 9, the automated, location dependent means further comprising:

a communication system between a crossing guard controller and the control system of the locomotive activated by approach of the locomotive to a level grade crossing; and the crossing guard controller providing the control system with a sound beam profile including direction.

14. The railroad crossing guard system of claim 13, further comprising: means responsive to weather conditions for further steering the sound beam.

* * * * *